US012162060B2

(12) United States Patent
Nishino

(10) Patent No.: US 12,162,060 B2
(45) Date of Patent: Dec. 10, 2024

(54) METHOD FOR MANUFACTURING PRODUCT, PUNCH, MANUFACTURING SYSTEM, DEVICE, AND PRODUCT

(71) Applicant: CANON KABUSHIKI KAISHA, Tokyo (JP)

(72) Inventor: Makoto Nishino, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 185 days.

(21) Appl. No.: 17/540,940

(22) Filed: Dec. 2, 2021

(65) Prior Publication Data

US 2022/0193746 A1 Jun. 23, 2022

(30) Foreign Application Priority Data

Dec. 17, 2020 (JP) ..... 2020-209152

(51) Int. Cl.
*B21D 5/02* (2006.01)

(52) U.S. Cl.
CPC ..... *B21D 5/0281* (2013.01)

(58) Field of Classification Search
CPC ..... B21D 5/02; B21D 5/0209; B21D 5/16; B21D 5/002; B21D 5/0281
USPC ..... 72/389.3
See application file for complete search history.

(56) References Cited

U.S. PATENT DOCUMENTS 3,474,657 A * 10/1969 Spiegel ..... B21D 5/0209 72/478
4,220,031 A * 9/1980 Naslund ..... B21D 11/08 72/379.6
5,303,572 A * 4/1994 Knudson ..... B21D 13/10 72/414
6,672,127 B2 * 1/2004 Maida ..... B21D 5/0209 72/396
6,866,180 B2 * 3/2005 Mahoney ..... B23K 20/1275 148/564
2020/0094302 A1 3/2020 Yahagi et al. ..... B21D 5/01
2020/0096932 A1 3/2020 Kobayashi et al. ..... F16B 5/08

FOREIGN PATENT DOCUMENTS

CN 102672011 9/2012
JP S63-184614 U 11/1988
JP S64-11019 1/1989
(Continued)

OTHER PUBLICATIONS

US 5,303,572A, Office Action dated Jan. 3, 2024.
(Continued)

*Primary Examiner* — Sarang Afzali
*Assistant Examiner* — Darrell C Ford
(74) *Attorney, Agent, or Firm* — Venable LLP

(57) ABSTRACT

A method for manufacturing a product includes placing a processing target material on a die, bringing a first punch into contact with the processing target material placed on the die, and bending the processing target material by pressing the processing target material by the first punch. The bringing the first punch into contact with the processing target material placed on the die includes bringing two pressing portions of the first punch into contact with two first groove portions of the processing target material and bringing a recess portion of the first punch into contact with a projection portion of the processing target material.

20 Claims, 19 Drawing Sheets

(56) References Cited

FOREIGN PATENT DOCUMENTS

| | | |
|---|---|---|
| JP | H03-77722 | 4/1991 |
| JP | 2003-053429 | 2/2003 |
| JP | 2003-245718 | 9/2003 |
| JP | 2012-192421 | 10/2012 |
| JP | 2019-038024 | 3/2019 |
| JP | 2019-104028 | 6/2019 |
| WO | 2007/031289 | 3/2007 |

OTHER PUBLICATIONS

US 3,474,657A, Office Action dated Jan. 3, 2024.
Japan 2003-245718, IDS dated Feb. 4, 2022.
Office Action dated Sep. 24, 2024 in counterpart Japanese Application No. 2020-209152, together with English translation thereof.
Office Action dated Sep. 11, 2024 in counterpart Chinese Application No. 202111540775.4, together with English translation thereof.

* cited by examiner

METHOD FOR MANUFACTURING PRODUCT, PUNCH, MANUFACTURING SYSTEM, DEVICE, AND PRODUCT

BACKGROUND OF THE INVENTION

Field of the Invention

The present invention relates to a technique for bending a processing target material.

Description of the Related Art

Japanese Patent Laid-Open No. 2003-245718 discloses a processing method for bending a processing target material. Japanese Patent Laid-Open No. 2003-245718 describes placing a processing target material on a die and bending the processing target material by pressing a punch against the processing target material.

However, sometimes the processing target material is displaced from a placing surface of the die in the horizontal direction or rotated with respect to a normal line perpendicular to the placing surface of the die when the processing target material is placed on the die. In the case where the processing target material is displaced from the die when the processing target material is placed on the die, it can be difficult to bend the processing target material with high precision.

SUMMARY OF THE INVENTION

According to a first aspect of the present invention, a method for manufacturing a product includes placing a processing target material on a die, bringing a first punch into contact with the processing target material placed on the die, and bending the processing target material by pressing the processing target material by the first punch. The processing target material has two first groove portions arranged at an interval in a first direction with reference to the processing target material and extending in the first direction, and a projection portion having a tapered shape, provided between the two first groove portions, and projecting with respect to bottom portions of the two first groove portions. The first punch has two pressing portions arranged at an interval in a second direction with reference to the first punch and extending in the second direction, and a recess portion provided between the two pressing portions and recessed with respect to the two pressing portions. The bringing the first punch into contact with the processing target material placed on the die includes bringing the two pressing portions into contact with the two first groove portions and bringing the recess portion into contact with the projection portion.

According to a second aspect of the present invention, a punch used for bending a processing target material, the punch includes two pressing portions arranged at an interval in a predetermined direction and extending in the predetermined direction, and a recess portion provided between the two pressing portions and recessed with respect to the two pressing portions.

According to a third aspect of the present invention, a product includes a first portion, a second portion, and a bent portion interconnecting the first portion and the second portion. The bent portion includes, on a bending inner side thereof, two slits arranged at an interval in a first direction and extending in the first direction, and a projection portion positioned between the two slits.

Further features of the present invention will become apparent from the following description of exemplary embodiments with reference to the attached drawings.

DESCRIPTION OF THE EMBODIMENTS

Embodiments of the present invention will be described in detail below with reference to drawings.

First Embodiment

Figure 1:
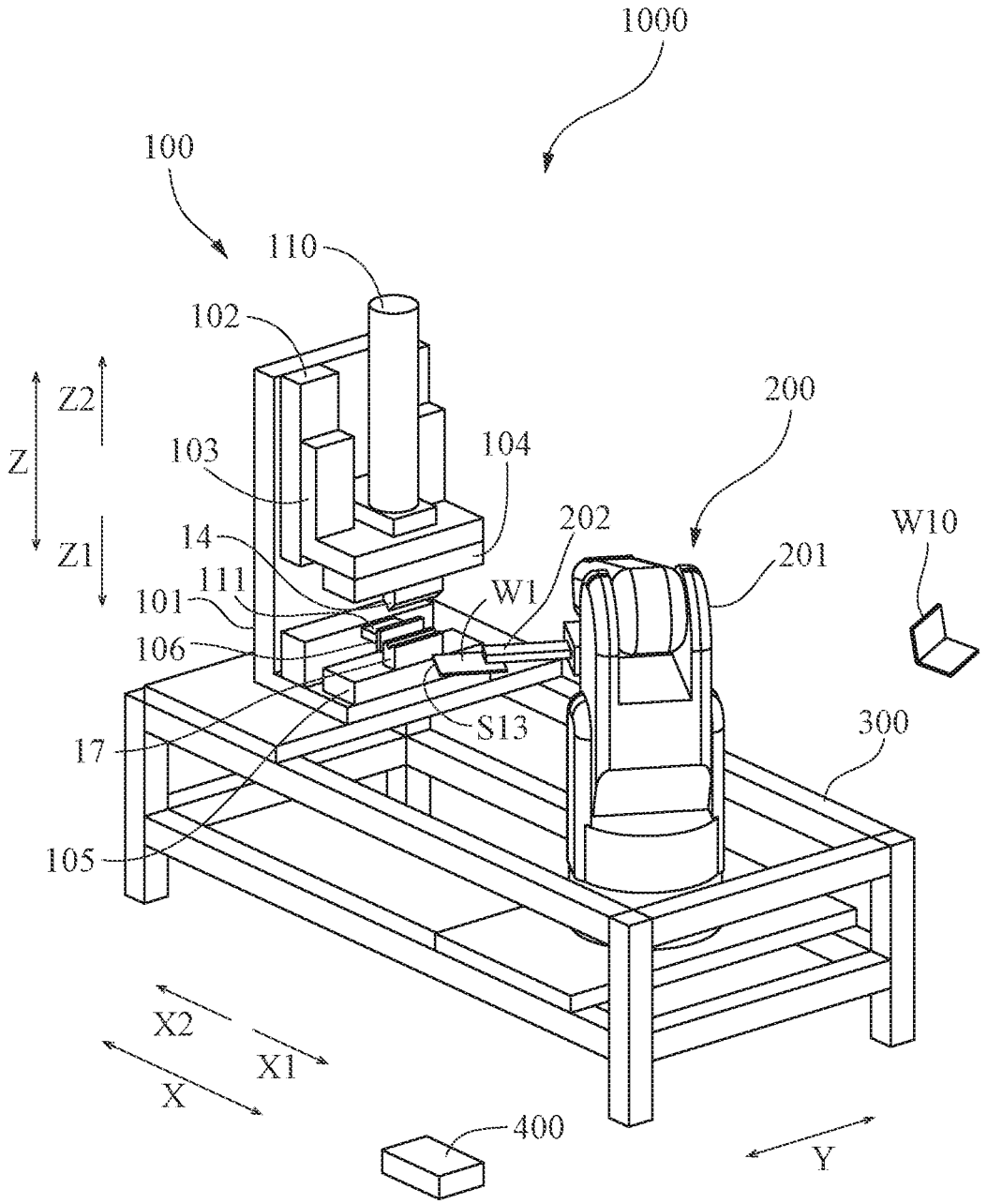
FIG. 1 is a perspective view of a manufacturing system according to a first embodiment.

FIG. 1 is a perspective view of a manufacturing system 1000 according to a first embodiment. The manufacturing system 1000 is installed in a factory. The manufacturing system 1000 includes a processing apparatus 100, a robot arm 200 serving as an example of a conveyance apparatus, a stand 300, and a control apparatus 400 serving as an example of a controller. The processing apparatus 100 and the robot arm 200 are fixed to the stand 300. The control apparatus 400 controls the processing apparatus 100 and the robot arm 200 in accordance with a registered program.

The processing apparatus 100 performs a bending process of a target object. A processing target material W1 that is a plastically deformable member such as a metal member or a plastic member serves as the target object. A flow in the processing target material W1 that is plastically deformable can be a plastic flow. For example, the processing target material W1 is preferably a metal member such as a metal plate. The processing apparatus 100 is configured such that a die 17 and a punch 14 are attachable thereto, and manufactures a product W10 by bending the processing target material W1 by using the attached die 17 and punch 14. The robot arm 200 is an apparatus capable of conveying the processing target material W1 to the die 17.

The processing apparatus 100 includes a frame 101, a fixed stage 102 fixed to the frame 101, and a movable stage 103 movable in a direction perpendicular to the fixed stage 102, that is, in a Z direction that is the up-down direction. In addition, the processing apparatus 100 includes a driving portion 110 that drives the movable stage 103 in the Z direction. The operation of the driving portion 110 is controlled by the control apparatus 400.

In addition, the processing apparatus 100 includes a punch holder 104 attached to the movable stage 103, and a die holder 105 attached to the frame 101. The punch holder 104 holds the punch 14, and the die holder 105 holds the die 17. The punch 14 serves as a first punch. A direction perpendicular to the Z direction which is the vertical direction, that is, a horizontal direction will be referred to as an X direction. In addition, another horizontal direction perpendicular to the X direction and the Z direction will be referred to as a Y direction. The processing apparatus 100 includes a backgauge 106 serving as an abutting portion that an end surface S13 of the processing target material W1 abuts, and a driving portion 111 that drives the backgauge 106 in the X direction. The operation of the driving portion 111 is controlled by the control apparatus 400.

The punch 14 is driven by the driving portion 110 in a Z1 direction, which is a downward direction directed to the die 17, and in a Z2 direction, which is an upward direction directed away from the die 17 and opposite to the Z1 direction. The punch 14 is movable to a retracted position and a processing position in the Z direction. The processing position is positioned below the retracted position. By moving the punch 14 in the Z1 direction from the retracted position to the processing position, the processing target material W1 placed on the die 17 can be bent. After the bending process of the processing target material W1 is finished, the punch 14 can be separated from the bent product by moving the punch 14 in the Z2 direction from the processing position to the retracted position.

The backgauge 106 is a member for positioning the processing target material W1 with respect to the die 17, and has a flat surface for abutting the end surface S13 of the processing target material W1. The flat surface of the backgauge 106 is a Y-Z surface extending in the Y direction and the Z direction. The backgauge 106 is driven in the X direction by being driven by the driving portion 111.

The backgauge 106 is driven by the driving portion 111 in a X1 direction directed to the die 17, and in a X2 direction directed away from the die 17 and opposite to the X1 direction. The X1 direction and the X2 direction are horizontal directions parallel to the X direction. The backgauge 106 is movable to a retracted position and a positioning position in the X direction. By moving the backgauge 106 in the X1 direction from the retracted position to the positioning position, the end surface S13 of the processing target material W1 can be caused to abut the backgauge 106 positioned at the positioning position, and thus the processing target material W1 can be positioned with respect to the die 17. In addition, the backgauge 106 can be separated from the processing target material W1 on the die 17 by moving the backgauge 106 in the X2 direction from the positioning position to the retracted position.

The robot arm 200 includes an arm body 201 and an end effector 202 attached to the arm body 201. The end effector 202 holds the processing target material W1, and is constituted by, for example, a gripping mechanism or a sucking mechanism. The robot arm 200 is capable of an operation of placing the processing target material W1 held by the end effector 202 on the die 17, and an operation of removing the bent product W10 from the die 17. In addition, the robot arm 200 is capable of an operation of causing the end surface S13 of the processing target material W1 to abut the backgauge 106 positioned at the positioning position to position the processing target material W1 with respect to the die 17, and releasing the processing target material W1 before lowering the punch 14 from the retracted position. In this manner, the robot arm 200 can place the processing target material W1 on the die 17. To be noted, after the processing target material W1 is placed on the die 17, the backgauge 106 is driven in the X2 direction and retracts to the retracted position.

Figure 19A:
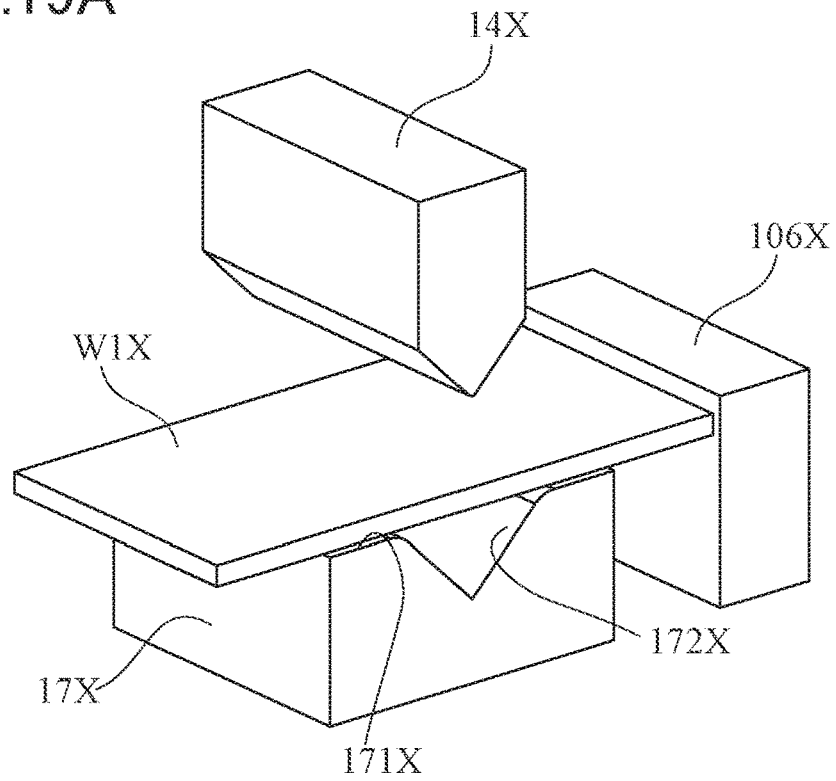
FIG. 19A is a perspective view of a punch, a die, and a processing target material of a comparative example.
Figure 19B:
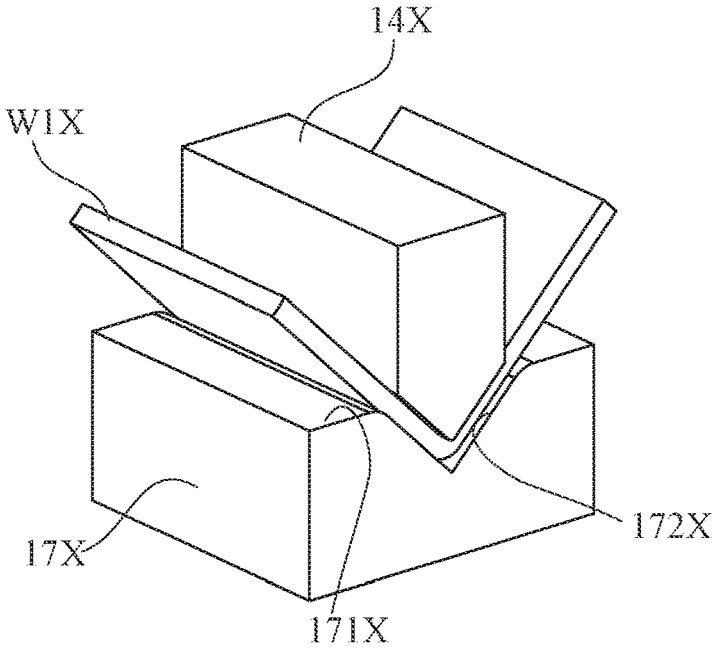
FIG. 19B is a perspective view of the punch, die, and processing target material of the comparative example.

Here, a comparative example will be described. FIGS. 19A and 19B are each a perspective view of a punch 14X, a die 17X, and a processing target material W1X of the comparative example. FIG. 19A illustrates the processing target material W1X before the bending process, and FIG. 19B illustrates the processing target material W1X after the bending process. The processing target material W1X of a predetermined shape as illustrated in FIG. 19A is formed by a cutting process.

The die 17X has a placing surface 171X and a V-shaped groove portion 172X. The processing target material W1X is placed on the placing surface 171X of the die 17X. At this time, an end surface of the processing target material W1X abuts a backgauge 106X positioned at a positioning position. As a result of this, the processing target material W1X is positioned with respect to the die 17X. Then, the backgauge 106X is retracted. Next, as illustrated in FIG. 19B, the punch 14X is lowered from above the processing target material W1X such that the processing target material W1X comes into contact with a pair of inclined surfaces of the groove portion 172X of the die 17X and the processing target material W1X is pressed, and thus the processing target material W1X is plastically deformed. According to such a process, the processing target material W1X is bent at an angle corresponding to the groove portion 172X.

However, the position and orientation of the processing target material W1X with respect to the die 17X can be displaced while or after positioning the processing target material W1X. That is, the processing target material W1X can be displaced in the horizontal direction along the placing surface 171X, or can be displaced in a rotation direction about the normal line of the placing surface 171X. Even if it is attempted to accurately position the processing target material W1X with respect to the die 17X as illustrated in FIG. 19A by using the robot arm 200 that is a conveyance apparatus illustrated in FIG. 1, the processing target material W1X can be slightly displaced from the die 17X.

Figure 2A:
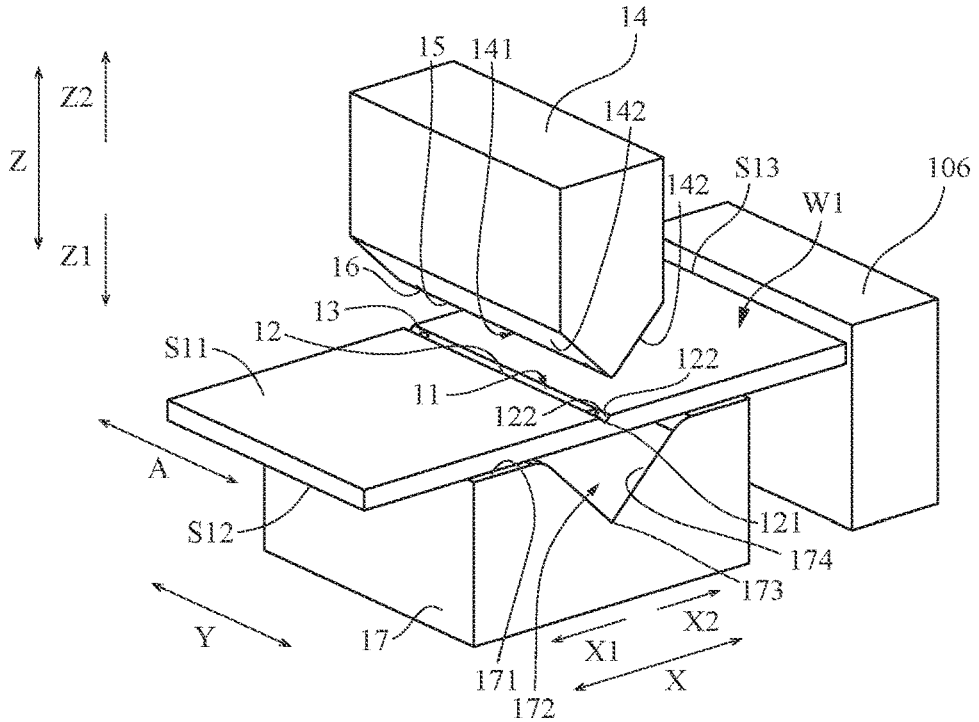
FIG. 2A is a perspective view of a punch, a die, and a processing target material according to the first embodiment.

Therefore, in the first embodiment, the punch 14 and the processing target material W1 are formed in such shapes that the position and orientation of the processing target material W1 are corrected in accordance with the punch 14 when the descending punch 14 comes into contact with the processing target material W1. The configuration of the punch 14, the die 17, and the processing target material W1 of the first embodiment will be described in detail below. FIG. 2A is a perspective view of the punch 14, the die 17, and the processing target material W1 illustrating a state in which the processing target material W1 is placed on the die 17.

The die 17 is a single body formed from metal. The die 17 includes a placing surface 171 that is an X-Y surface spreading in the X direction and the Y direction, and a groove portion 172 that is recessed in a V shape with respect to the placing surface 171. The groove portion 172 extends in the Y direction. The groove portion 172 has a pair of inclined surfaces 174 inclined toward a bottom portion 173.

Figure 2B:
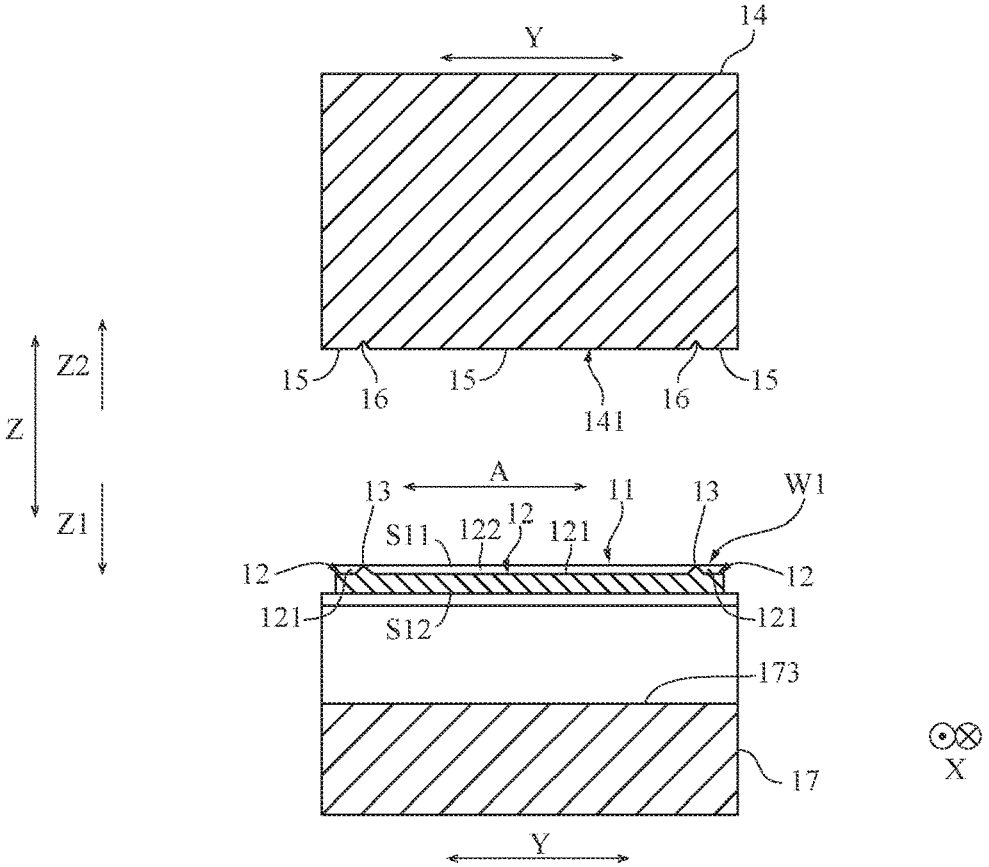
FIG. 2B is a section view of the punch, die, and processing target material according to the first embodiment.

FIG. 2B is a section view of the punch 14, the die 17, and the processing target material W1. Specifically, FIG. 2B illustrates the cross-section of the punch 14, the die 17, and the processing target material W1 including the bottom portion 173 of the groove portion 172 taken along a Y-Z plane extending in the Y direction and the Z direction as viewed in the X direction.

The processing target material W1 includes a surface S11, and a surface S12 opposite to the surface S11. The processing target material W1 serving as a bending target object of the first embodiment has a different configuration from the processing target material W1X illustrated in FIG. 19A serving as a bending target object of the comparative example. The processing target material W1 includes a guiding portion 11 formed on the surface S11. The guiding portion 11 extends in an A direction in the surface S11. The punch 14 has a distal end portion 141 projecting in the Z1 direction in a V shape as viewed in the Y direction. The distal end portion 141 extends in the Y direction in a lower portion of the punch 14. The distal end portion 141 of the punch 14 descending in the Z1 direction comes into contact with the guiding portion 11 of the processing target material W1, and thus the position and orientation of the processing target material W1 are corrected such that the guiding portion 11 engages with the distal end portion 141.

The guiding portion 11 of the processing target material W1 includes a plurality of, for example, three groove portions 12 defined in the surface S11, and a plurality of, for example, two projection portions 13 formed on the surface S11. Part of the surface S12 corresponding to the back side of the projection portions 13 on the surface S11 are flat surface. The groove portions 12 serve as first groove portions. The projection portions 13 of the first embodiment each project with respect to a bottom portion 121 of each of the groove portions 12. The number of the projection portions 13 is smaller than the number of the groove portions 12 by 1. Further, in the surface S11 of the processing target material W1, the groove portions 12 and the projection portions 13 are alternately arranged in the A direction. Here, the A direction serves as a first direction with reference to the processing target material W1.

The plurality of groove portions 12 are each a groove extending in the A direction and a V-shaped groove extending in the A direction in the first embodiment. The plurality of groove portions 12 are arranged at intervals in the A direction. Each projection portion 13 is disposed between two adjacent groove portions 12 among the plurality of groove portions 12.

The groove portions 12 each include a pair of inclined surfaces 122 inclined such that the groove width becomes smaller toward a bottom portion 121 of the groove portion 12. The pair of inclined surfaces 122 extend in the A direction. To be noted, although the groove portions 12 each have a V shape, that is, each have a linear bottom portion 121, the configuration is not limited to this. It suffices as long as the groove portions 12 each have a pair of inclined surfaces 122, and for example, the groove portions 12 may each have a U shape in which the bottom portion 121 is a surface. In this case, the surface of the bottom portion 121 may be, for example, a flat surface or a curved surface. The projection portions 13 are each formed in a tapered shape projecting with respect to the bottom portions 121 of the two groove portions 12 between which the projection portion 13 is positioned in the A direction.

In the first embodiment, the punch 14 is a single body formed from metal. As a result of this, the punch 14 can be produced at a low cost. The punch 14 includes a pair of inclined surfaces 142. The inclined surfaces 142 are each formed to extend in the Y direction. The inclined surfaces 142 each extend in a tapered shape in the Z1 direction as viewed in the Y direction. That is, the punch 14 is formed such that the width thereof in the X direction is smaller at a position closer to the distal end portion 141 as viewed in the Y direction.

The distal end portion 141 of the punch 14 includes a plurality of, for example, three pressing portions 15, and a plurality of, for example, two recess portions 16. The recess portions 16 are recessed in the Z2 direction with respect to the pressing portions 15. The recess portions 16 are each defined in a cutout shape as viewed in the X direction. The pressing portions 15 are projection portions as compared with the recess portions 16. In the first embodiment, the number of the pressing portions 15 is equal to the number of the groove portions 12, and the number of the recess portions 16 is equal to the number of the projection portions 13. The number of the recess portions 16 is smaller than the number of the pressing portions 15 by 1. Further, in the distal end portion 141 of the punch 14, the pressing portions 15 and the recess portions 16 are alternately arranged in the Y direction. Here, the Y direction is a predetermined direction, and serves as a second direction with reference to the punch 14. In the first embodiment, the distal end portion 141 of the punch 14 engages with the guiding portion 11 of the processing target material W1 when the punch 14 descends, and thus the position and orientation of the processing target material W1 is corrected such that the A direction of the processing target material W1 matches the Y direction of the punch 14. The distal end portion 141 of the punch 14 engaging with the guiding portion 11 of the processing target material W1 means that the pressing portions 15 engage with the groove portions 12 and the recess portions 16 engage with the projection portions 13.

Each of the plurality of pressing portions 15 is a mountain portion having a V shape which is convex downward whose ridgeline extends in the Y direction. The distal end of the pressing portion 15, which is the ridgeline of the mountain portion, is preferably rounded. The plurality of pressing portions 15 are arranged at intervals in the Y direction. The recess portions 16 are each disposed between two adjacent pressing portions 15 among the plurality of pressing portions 15.

To be noted, although the processing target material W1 includes the plurality of projection portions 13 in the first embodiment, the configuration is not limited to this, and it suffices as long as at least one projection portion 13 is provided. In addition, it suffices as long as the processing target material W1 has at least two groove portions 12. For example, in the case where the length of a planned bending region of the processing target material W1 in the A direction is 20 mm or less, a configuration in which one projection portion 13 is disposed at the center of the planned bending region of the processing target material W1 and two groove portions 12 are arranged in the A direction such that the one projection portion 13 is interposed therebetween may be employed.

Similarly, although the punch 14 includes the plurality of recess portions 16, the configuration is not limited to this, and it suffices as long as at least one recess portion 16 is provided. In addition, it suffices as long as the punch 14 includes at least two pressing portions 15.

Figure 3A:
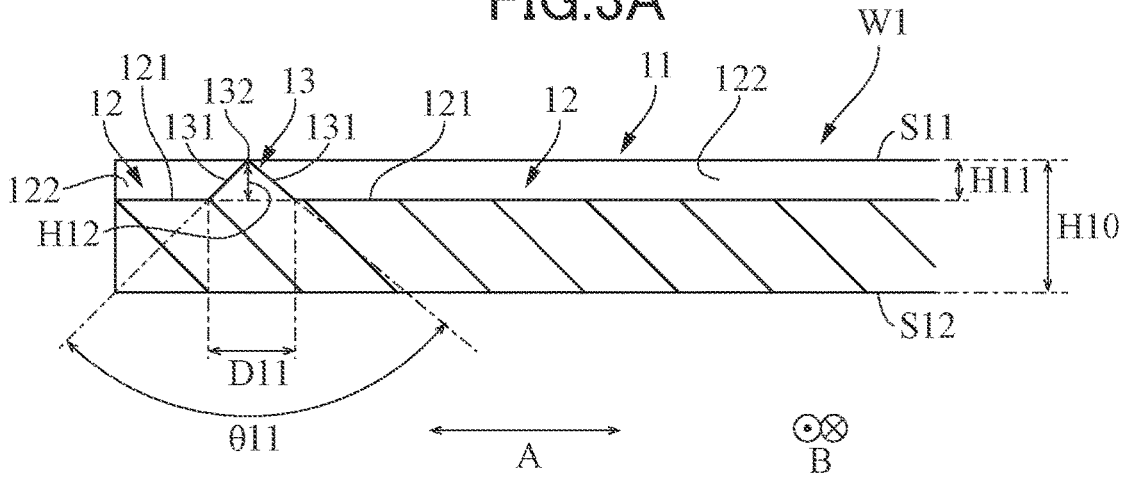
FIG. 3A is an enlarged section view of the processing target material according to the first embodiment.
Figure 3B:
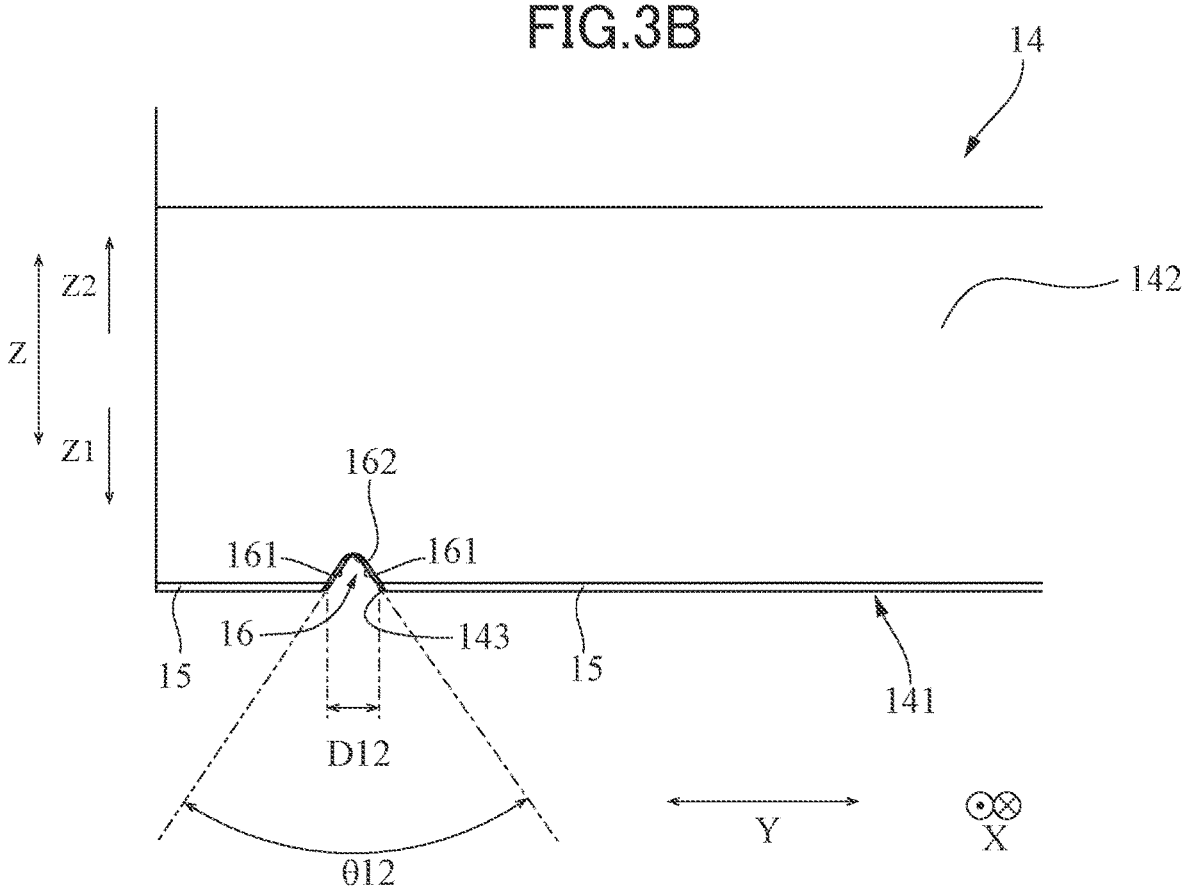
FIG. 3B is an enlarged side view of the punch according to the first embodiment.

A configuration of the projection portions 13 of the processing target material W1 and the recess portions 16 of the punch 14 will be described in further detail. Description will be given focusing on one of the plurality of projection portions 13 of the processing target material W1, and two of the plurality of groove portions 12 between which the one projection portion 13 is provided. In addition, description will be given focusing on one of the plurality of recess portions 16 of the punch 14 corresponding to the one projection portion 13, and two of the plurality of pressing portions 15 corresponding to the two groove portions 12 between which the one recess portion 16 is provided. FIG. 3A is an enlarged section view of the processing target material W1 in which a part of the cross-section of the processing target material W1 is viewed in a direction perpendicular to the A direction. FIG. 3B is an enlarged side view of the punch 14 in which a part of the punch 14 is viewed in the X direction.

The projection portion 13 of the processing target material W1 includes a pair of inclined surfaces 131 and a distal end portion 132. The inclined surfaces 131 each serve as a first inclined surface. The pair of inclined surfaces 131 are inclined in a shape tapered from the bottom portion 121 of the corresponding one of the groove portions 12 toward the distal end portion 132. That is, the pair of inclined surfaces 131 are inclined such that the width of the projection portion 13 in the A direction becomes larger from the distal end portion 132 of the projection portion 13 toward the bottom portion 121 of the corresponding one of the groove portions 12.

The recess portion 16 of the punch 14 includes a pair of inclined surfaces 161 and a bottom portion 162. The inclined surfaces 161 each serve as a second inclined surface. The pair of inclined surfaces 161 are inclined in a shape tapered toward the bottom portion 162 of the recess portion 16. That is, the pair of inclined surfaces 161 are inclined such that the width of the recess portion 16 in the Y direction becomes smaller from corresponding one of the pressing portions 15 toward the bottom portion 162.

Figure 4A:
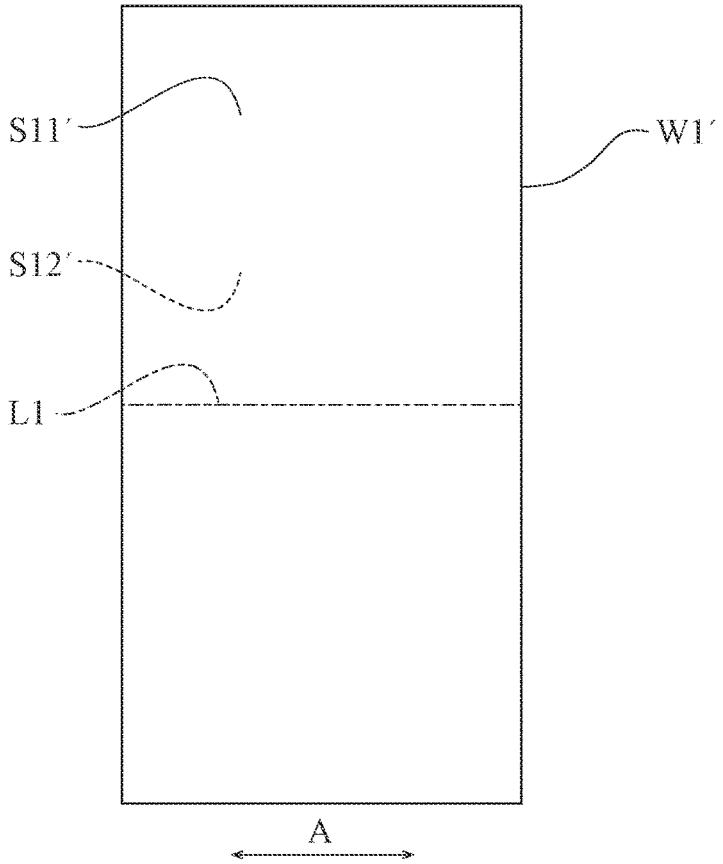
FIG. 4A is a plan view of a base material according to the first embodiment.

Each step of a manufacturing method for the product W10 will be described below. FIG. 4A is a plan view of a base material W1' according to the first embodiment. The guiding portion 11 is not formed on the base material W1' yet, and the base material W1' has the same configuration as the processing target material W1X illustrated in FIG. 19A.

The base material W1' is formed by cutting into a predetermined shape by a cutting method selected from various methods such as laser cutting, press punching, wire cutting, and etching. The base material W1' illustrated in FIG. 4A has a rectangular shape in plan view. The processing target material W1 is formed by forming the guiding portion 11 illustrated in FIGS. 2A and 2B on a surface S11' serving as a first surface of the base material W1' illustrated in FIG. 4A. A one-dot-chain line L1 illustrated in FIG. 4A is a virtual line indicating the position where the guiding portion 11 is to be formed, that is, a virtual line indicating the planned bending region, and extends in the A direction.

Figure 4B:
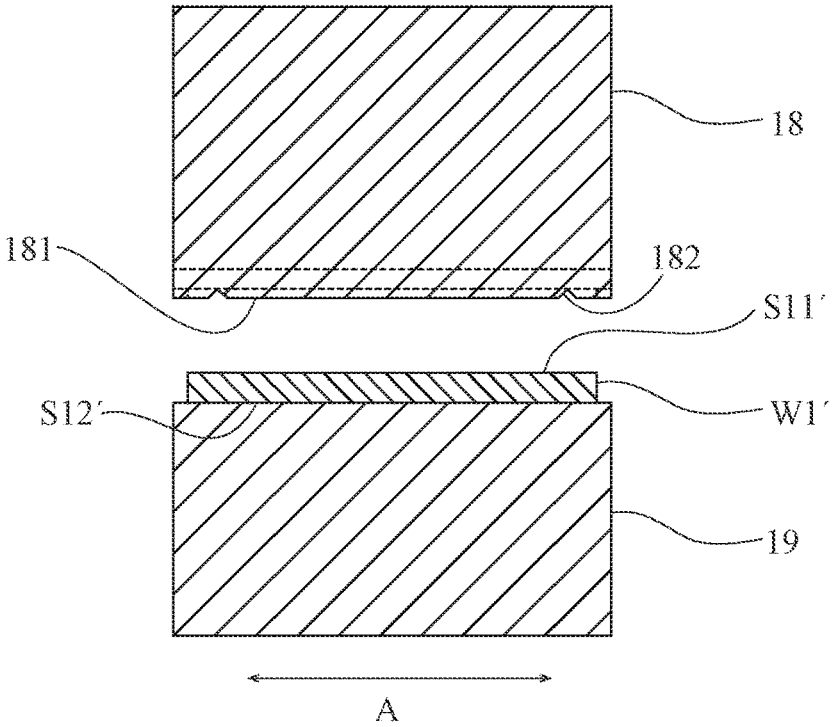
FIG. 4B is an explanatory diagram of a manufacturing method according to the first embodiment.
Figure 5A:
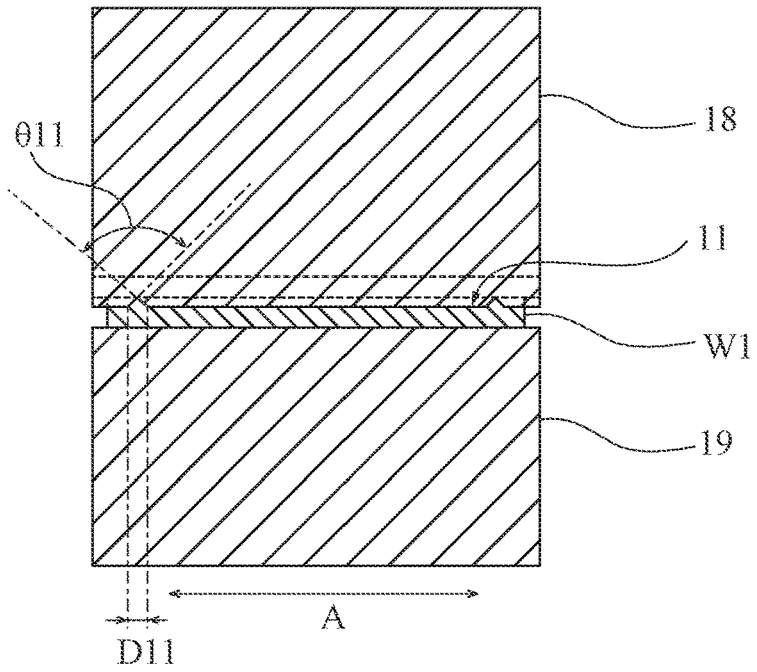
FIG. 5A is an explanatory diagram of the manufacturing method according to the first embodiment.
Figure 5B:
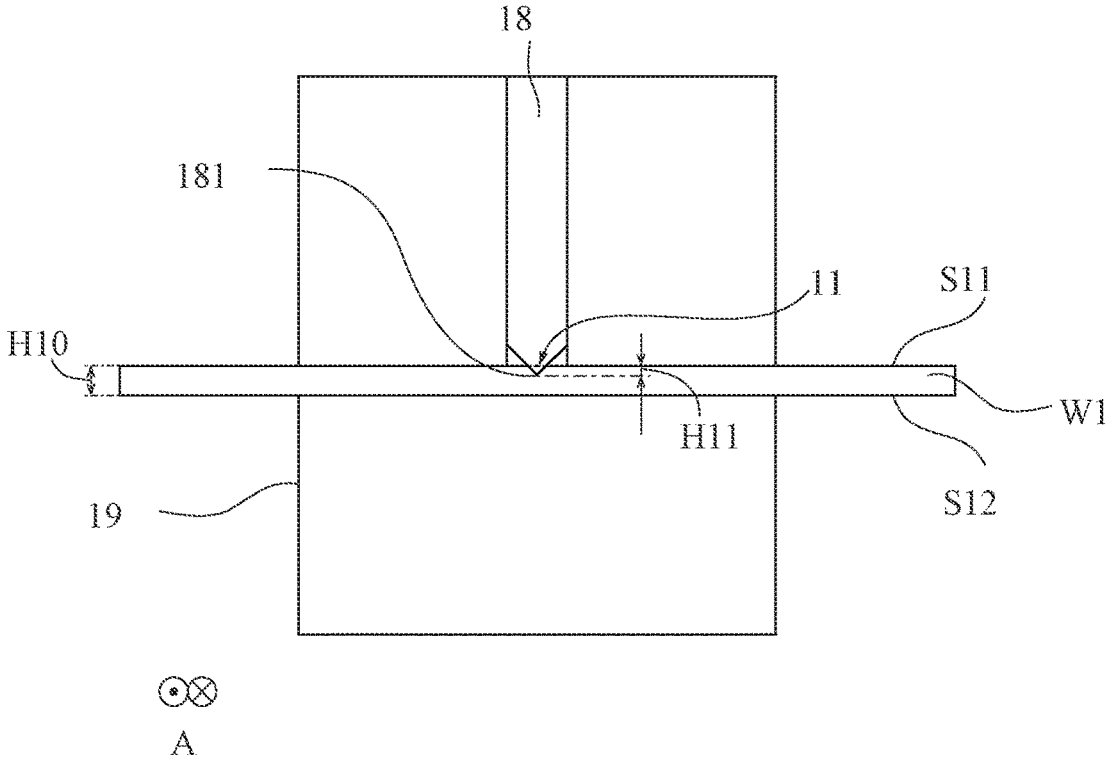
FIG. 5B is an explanatory diagram of the manufacturing method according to the first embodiment.

A step for forming the processing target material W1 from the base material W1' illustrated in FIG. 4A will be described. FIGS. 4B, 5A, and 5B are explanatory diagrams of the step for forming the processing target material W1 from the base material W1'. FIG. 4B illustrates a state before forming the guiding portion 11, and FIGS. 5A and 5B illustrate a state in which the guiding portion 11 is being formed. FIGS. 4B and 5A are each as section view, and FIG. 5B is a side view.

A punch 18 and a die 19 illustrated in FIG. 4B is set in an unillustrated processing apparatus. The punch 18 serves as a second punch. The punch 18 includes a distal end portion 181 having such a shape as to transfer the guiding portion 11 onto the base material W1'. The base material W1' has a surface S11' serving as a first surface onto which the guiding portion 11 is to be transferred, and a surface S12' serving as a second surface opposite to the surface S11'.

Parts of the distal end portion 181 of the punch 18 that transfer the groove portions 12 onto the surface 511' are each formed in a convex V shape in side view. The angle of the distal end portion 181 is, for example, 90°. In addition, parts of the distal end portion 181 of the punch 18 that transfer the projection portions 13 onto the surface S11' are clearance portions 182.

First, as illustrated in FIG. 4B, the base material W1' is placed on the die 19 such that the surface S12' of the base material W1' is in contact with the placing surface of the die 19. Then, the punch 18 is lowered to press the surface S11' of the base material W1' by the punch 18. As a result of this, the processing target material W1 in which the guiding portion 11 is formed on the surface S11 is obtained as illustrated in FIGS. 5A and 5B. As described above, the guiding portion 11 can be formed on the processing target material W1 by one punching operation by using the punch 18 and the die 19.

Next, a step of placing the processing target material W1 on the die 17 as illustrated in FIG. 2A is performed by conveying the processing target material W1 to the die 17 by the robot arm 200 as illustrated in FIG. 1. In this step, the robot arm 200 causes the end surface S13 of the held processing target material W1 to abut the backgauge 106 positioned at the positioning position. As a result of this, the processing target material W1 is positioned with respect to the die 17. The robot arm 200 releases the processing target material W1, and the backgauge 106 retracts in the X2 direction to the retracted position.

Next, a step of lowering the punch 14 in the Z1 direction and bringing the punch 14 into contact with the processing target material W1 placed on the die 17 is performed. In this step, the distal end portion 141 of the punch 14 is brought into contact with the guiding portion 11 of the processing target material W1. Specifically, the pressing portions 15 of the punch 14 are brought into contact with the groove portions 12 of the processing target material W1, and the recess portions 16 of the punch 14 are brought into contact with the projection portions 13 of the processing target material W1.

Figure 6A:
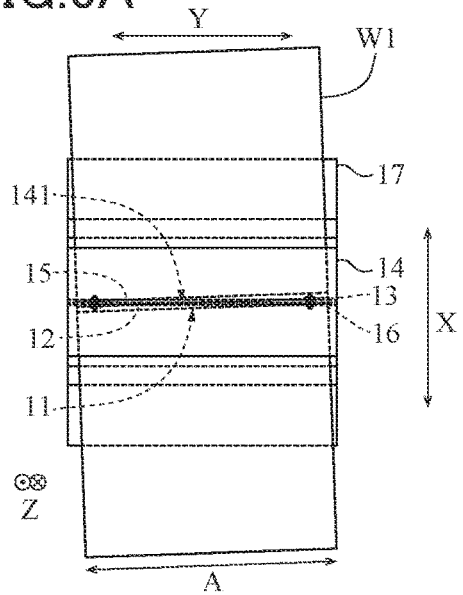
FIG. 6A is an explanatory diagram of the manufacturing method according to the first embodiment.
Figure 6B:
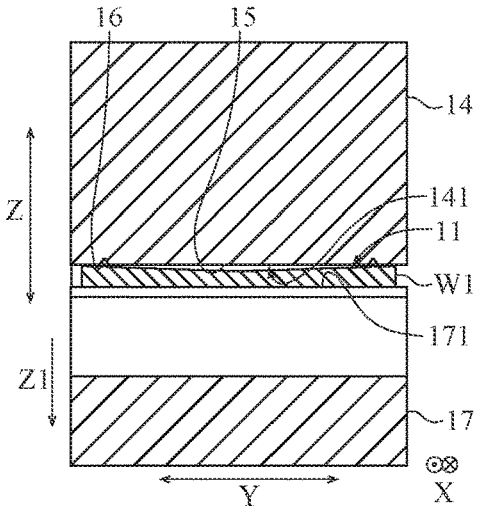
FIG. 6B is an explanatory diagram of the manufacturing method according to the first embodiment.
Figure 6C:
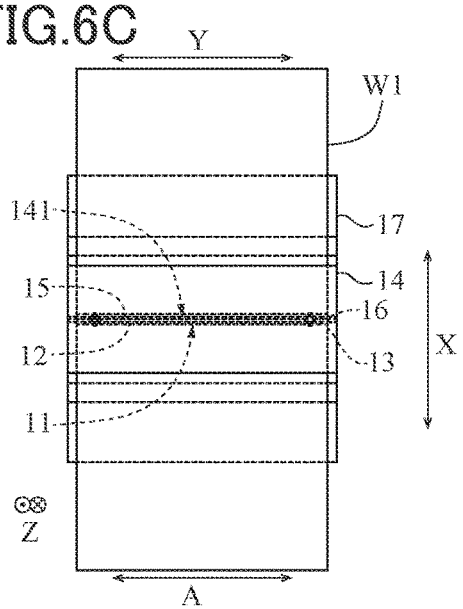
FIG. 6C is an explanatory diagram of the manufacturing method according to the first embodiment.
Figure 6D:
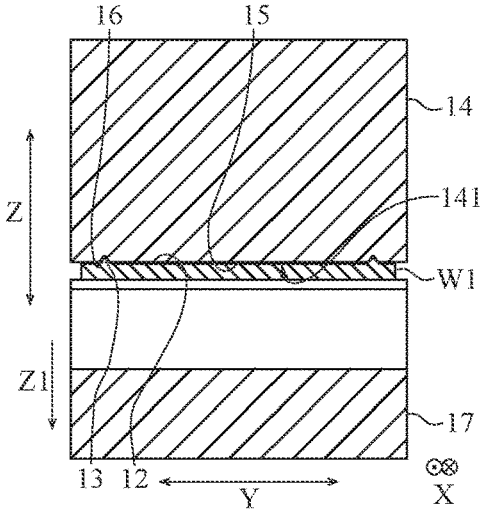
FIG. 6D is an explanatory diagram of the manufacturing method according to the first embodiment.
Figure 6E:
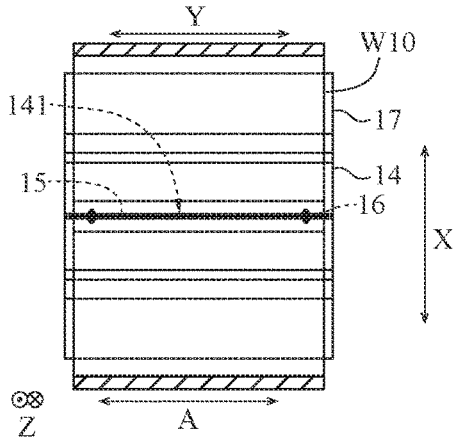
FIG. 6E is an explanatory diagram of the manufacturing method according to the first embodiment.
Figure 6F:
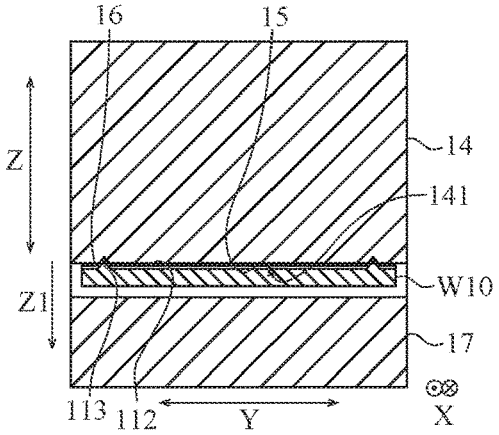
FIG. 6F is an explanatory diagram of the manufacturing method according to the first embodiment.

FIGS. 6A and 6B are explanatory diagrams of the step of bringing the punch 14 into contact with the processing target material W1, and illustrate a moment when the distal end portion 141 of the punch 14 comes into contact with the guiding portion 11 of the processing target material W1. FIGS. 6C and 6D are explanatory diagrams of the step of bringing the punch 14 into contact with the processing target material W1, and illustrate a state in which the punch 14 has been lowered further from the state illustrated in FIGS. 6A and 6B in which the distal end portion 141 of the punch 14 is brought into contact with the guiding portion 11 of the processing target material W1. FIGS. 6E and 6F are explanatory diagrams of a step of bending the processing target material W1 by pressure from the punch 14, and illustrate a state in which the bending process has been completed. FIGS. 6A, 6C, and 6E are each a top view, and FIGS. 6B, 6D, and 6F are each a section view.

As illustrated in FIGS. 6A and 6B, by lowering the punch 14 in the Z1 direction from the retracted position, the distal end portion 141 of the punch 14 is brought into contact with the guiding portion 11 of the processing target material W1. That is, the pressing portions 15 of the punch 14 are brought into contact with the groove portions 12 of the processing target material W1, and the recess portions 16 of the punch 14 are brought into contact with the projection portions 13 of the processing target material W1. At this time, the pressing portions 15 of the punch 14 press the inclined surfaces 122 of the groove portions 12 illustrated in FIG. 3A, and the inclined surfaces 161 of the recess portions 16 of the punch 14 illustrated in FIG. 3B press the inclined surfaces 131 of the projection portions 13 illustrated in FIG. 3A.

As a result of this, in the case where the processing target material W1 is in a state of having rotated about the normal line of the placing surface 171 of the die 17 as illustrated in FIGS. 6A and 6B, that is, where the A direction is inclined with respect to the Y direction, the state illustrated in FIGS. 6C and 6D is taken. That is, the orientation of the processing target material W1 is corrected such that the A direction is parallel to the Y direction. In addition, in the case where the processing target material W1 is displaced from the die 17 in the X direction and Y direction, which are horizontal directions, in FIGS. 6A and 6B, the position of the processing target material W1 in the X direction and Y direction is also corrected as illustrated in FIGS. 6C and 6D. To be noted, the position and orientation of the processing target material W1 are corrected in the case where the distal end portion 141 of the punch 14 comes into contact with the entire region of the guiding portion 11 in the A direction, that is, in the case where all the pressing portions 15 of the punch 14 come into contact with the groove portions 12. Here, in the step illustrated in FIGS. 6A to 6D, the processing target material W1 is pressed by the lowered punch 14, but is not deformed or is only slightly warped.

When the punch 14 is further lowered in the Z1 direction from the state illustrated in FIGS. 6C and 6D, the distal end portion 141 of the punch 14 presses the processing target material W1. As a result of this, the processing target material W1 starts bending by plastic deformation.

As the bending process of the processing target material W1 progresses, the groove portions 12 are deformed and retracted from the pressing portions 15, and the projection portions 13 are deformed and flow to the recess portions 16. That is, the material of the projection portions 13 of the processing target material W1 flows to the bending inner side and into the recess portions 16 of the punch 14. As a result of this, the displacement of the processing target material W1 in the Y direction is corrected also during the bending process of the processing target material W1. That is, although the pressing portions 15 are disengaged from the groove portions 12 during the bending process of the processing target material W1, the recess portions 16 are engaged with the deformed projection portions 13, and therefore the displacement of the processing target material W1 in the Y direction can be suppressed.

According to the operation described above, for example, even if the processing target material W1 is displaced from the die 17 by about 0.2 mm in the Y direction when the processing target material W1 is placed on the die 17, the displacement of the processing target material W1 in the Y direction can be suppressed to 0.02 mm or less during the bending process of the processing target material W1.

The punch 14 is lowered in the Z1 direction from above the processing target material W1 until the processing target material W1 comes into contact with the pair of inclined surfaces 174 of the groove portion 172 of the die 17 illustrated in FIG. 2A to press the processing target material W1 by the punch 14, and thus the processing target material W1 is plastically deformed. Then, the bending process of the processing target material W1 is completed as illustrated in FIGS. 6E and 6F, and thus the product W10 is formed. According to the first embodiment, the position and orientation of the processing target material W1 with respect to the die 17 are corrected by the punch 14, and thus the bending process of the processing target material W1 can be performed with high precision. Therefore, the product W10 of high dimensional precision is manufactured.

Figure 7:
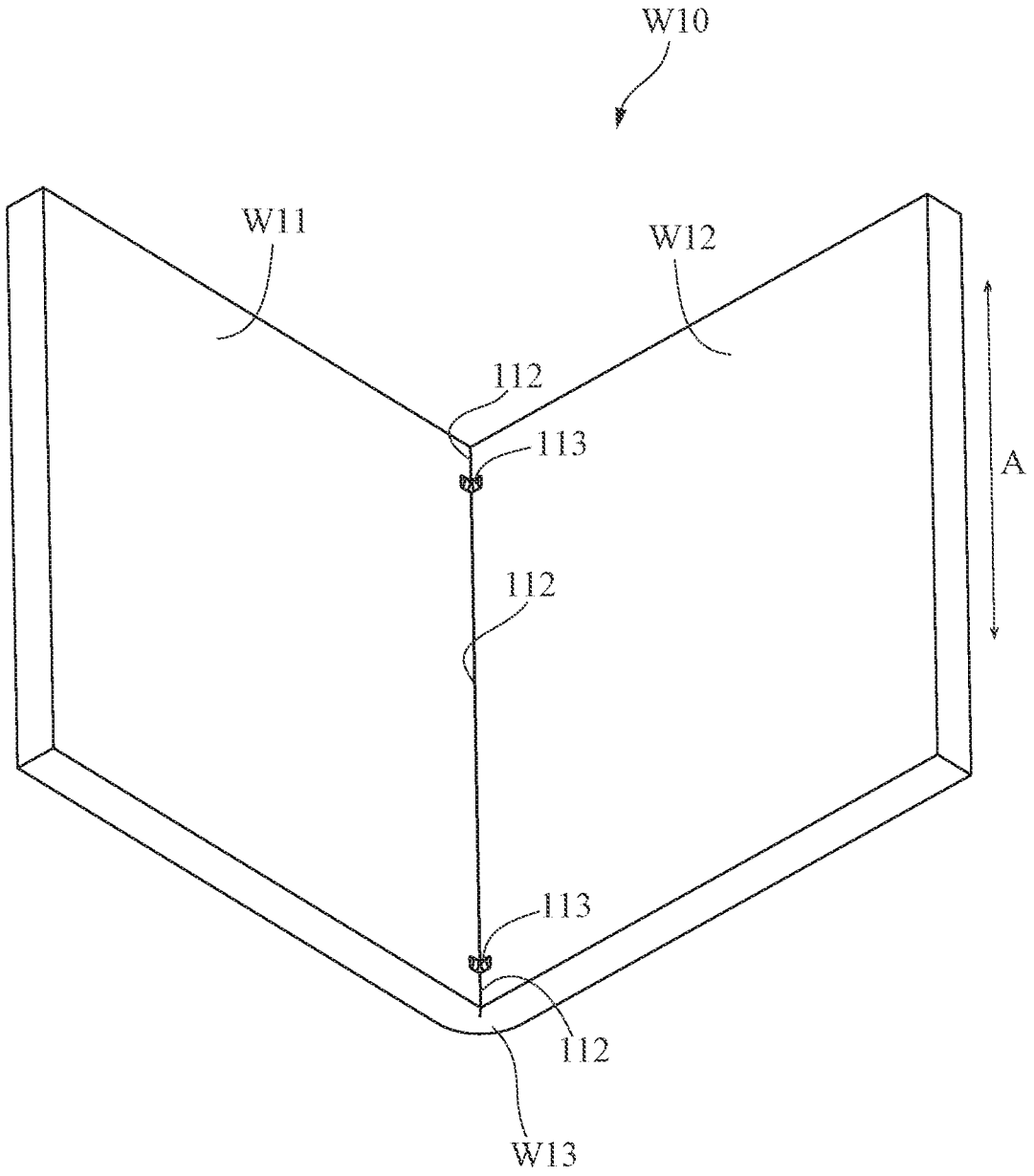
FIG. 7 is a perspective view of a product according to the first embodiment.

FIG. 7 is a perspective view of the product W10 formed by the bending process of the processing target material W1. The product W10 includes a portion W11 serving as an example of a first portion, a portion W12 serving as an example of a second portion, and a bent portion W13. The portion W12 intersects with the portion W11, and the portions W11 and W12 are interconnected by the bent portion W13. The portions W11 and W12 each have, for example, a flat plate shape.

In the state in which the bending process of the processing target material W1 has completed, the groove portions 12 illustrated in FIG. 2A are deformed, and thus the pairs of inclined surfaces 122 of the groove portions 12 are in firm contact with or are close to each other. That is, the bent portion W13 has a plurality of slits 112 formed by deformation of the plurality of groove portions 12 in the bending inner side of the bent portion W13. The slits 112 each correspond to one of the deformed groove portions 12. Therefore, the number of the slits 112 is equal to the number of the groove portions 12. The plurality of slits 112 each linearly extend in the A direction. The plurality of slits 112 are arranged at intervals in the A direction.

In addition, the bent portion W13 has a plurality of protrusion portions 113 formed by deformation of the plurality of projection portions 13 on the bending inner side of the bent portion W13. The protrusion portions 113 also each serve as a projection portion. The protrusion portions 113 each correspond to one of the projection portions 13. Therefore, the number of the protrusion portions 113 is equal to the number of the projection portions 13. The protrusion portions 113 are each disposed between two adjacent slits 112 among the plurality of slits 112. By measuring the positions and angles of the protrusion portions 113 present on the bending inner side of the product W10 with respect to the slits 112 by using image processing, a non-contact laser sensor, or the like, whether the precision of the product W10 is high or low can be determined.

Here, a preferable example of the dimensions of the processing target material W1 and the punch 14 will be described with reference to FIGS. 3A and 3B. A depth H11 of each of the groove portions 12 is preferably 0.3 times to 0.5 times of a thickness H10 of the processing target material W1. For example, in the case where the thickness H10 of the processing target material W1 is 1 mm, the depth H11 of the groove portions 12 is preferably 0.3 mm to 0.5 mm. By setting the depth H11 of the groove portions 12 to 0.5 times or less of the thickness H10 of the processing target material W1, breakage of the processing target material W1 at the groove portions 12 when forming the groove portions 12 or during the bending process can be effectively suppressed. In addition, by setting the depth H11 of the groove portions 12 to 0.3 times or more of the thickness H10 of the processing target material W1, the pressing portions 15 of the punch 14 can be reliably engaged with the groove portions 12.

A height H12 of the projection portions 13 is preferably set to 1 time to 1.1 times of the depth H11 of the groove portions 12. Among directions intersecting with the A direction, a direction perpendicular to the A direction will be referred to as a B direction. As viewed in the B direction, an angle θ11 formed by the pair of inclined surfaces 131 of each of the projection portions 13 is preferably 80° to 90°. By setting the angle θ11 to 90° or less, the recess portions 16 of the punch 14 can be reliably engaged with the projection portions 13 of the processing target material W1, and the processing target material W1 can be reliably positioned in the Y direction. In addition, by setting the angle θ11 to 80° or more, the amount of correction of the position of the processing target material W1 in the Y direction possible by the inclined surfaces 131 of the projection portion 13 can be increased.

The width D11 of each of the projection portions 13 is the width of the widest portion of the projection portion 13 in the A direction. Although the projection portions 13 each have a triangular cross-section as illustrated in FIG. 3A, the configuration is not limited to this, and the sectional shape of the projection portion 13 may be a trapezoidal shape having the surface S11 side of the processing target material W1 as the short side. In the case where the projection portion 13 has a triangular cross-section, the width D11 of the projection portion 13 may be determined from the depth H11 of the groove portions 12 and the angle θ11. In the case where the projection portion 13 has a trapezoidal cross-section, the width D11 of the projection portion 13, which is the long side of the projection portion 13, may be determined from the length of the short side of the projection portion 13, the depth H11 of the groove portions 12, and the angle θ11 of the projection portion 13.

As illustrated in FIG. 3B, the shape of each of the recess portions 16 as viewed in the X direction is preferably a triangular shape or a shape similar to a triangle. In addition, the shape of the recess portion 16 as viewed in the X direction may be a trapezoidal shape, or an arcuate shape. A portion 143 where a ridgeline serving as a boundary between the recess portion 16 and an inclined surface 142 and a ridgeline of a pressing portion 15 cross is preferably rounded. In consideration of reduction of the frictional force between the portion 143 and the inclined surfaces 131 of the projection portion 13, the amount of rounding of the portion 143 is preferably 0.2 mm or more.

An angle θ12 of the pair of inclined surfaces 161 of the recess portion 16 is preferably 60° to 90° as viewed in the X direction. By setting the angle θ12 of the recess portion 16 to 60° or more, the recess portions 16 can be reliably engaged with the projection portions 13. In addition, by setting the angle θ12 of the recess portion 16 to 90° or less, the deformed projection portions 13 can be effectively caused to flow to the recess portions 16 when bending the processing target material W1, and thus displacement of the processing target material W1 in the Y direction can be effectively suppressed.

A width D12 of the recess portion 16 is the width of the widest portion of the recess portion 16 in the Y direction. The width D12 of the recess portion 16 in the Y direction is preferably 0.9 times to 1 time of the width D11 of the projection portion 13 in the A direction. By setting the width D12 of the recess portion 16 to be equal to or less than the width D11 of the projection portion 13, the recess portions 16 can be reliably engaged with the projection portions 13. In addition, by setting the width D12 of the recess portion 16 to 0.9 times or more of the width D11 of the projection portion 13, the amount of correction in which displacement of the processing target material W1 in the Y direction can be corrected when the recess portions 16 engage with the projection portions 13 can be increased.

Figure 8A:
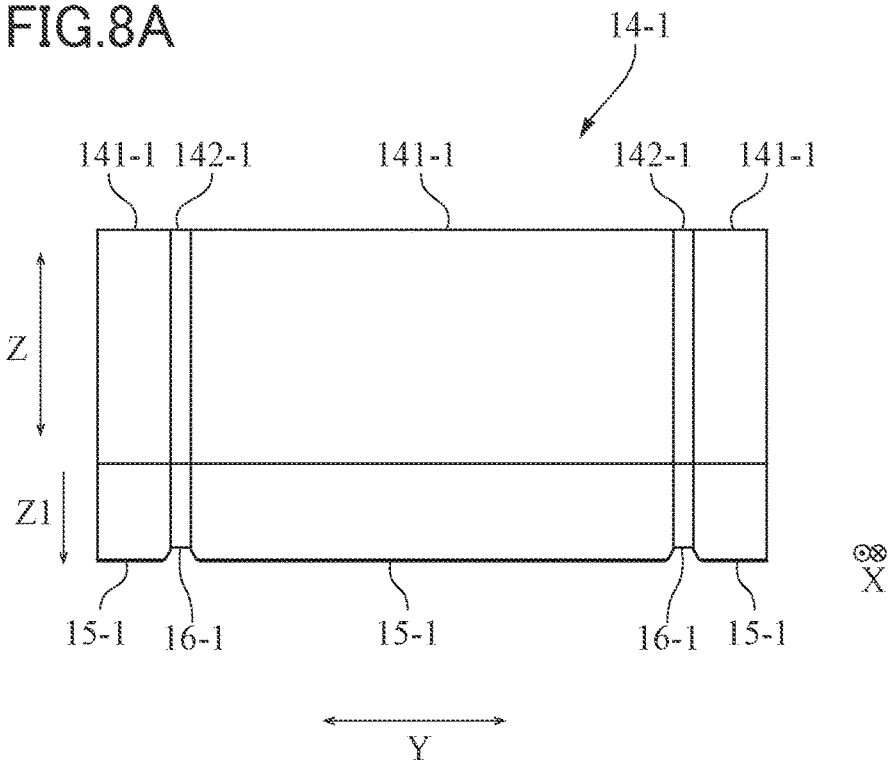
FIG. 8A is a side view of a punch of a modification example.
Figure 8B:
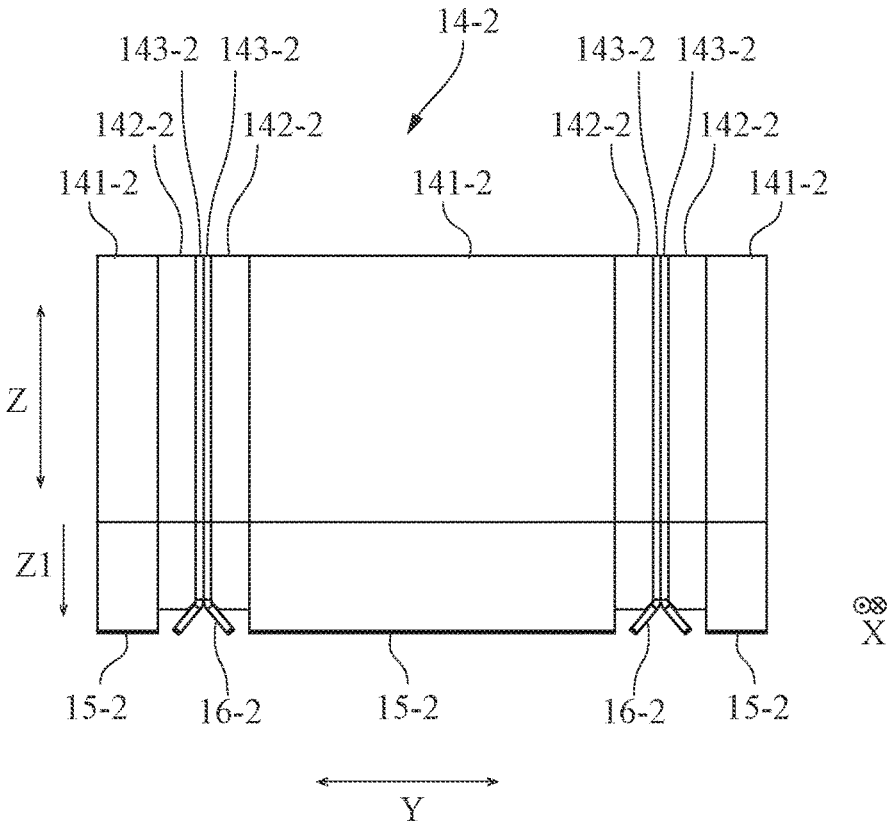
FIG. 8B is a side view of a punch of a modification example.

To be noted, although a case where the punch 14 is constituted by a single body formed from metal has been described in the first embodiment, the configuration is not limited to this. FIGS. 8A and 8B are each a side view of a punch of a modification example.

A punch 14-1 of the modification example illustrated in FIG. 8A includes a plurality of blocks 141-1 and a plurality of blocks 142-1 laminated in the Y direction. The blocks 141-1 and 142-1 are each formed from metal.

The blocks 141-1 are each a block including a pressing portion 15-1 and a side surface of a recess portion 16-1. The blocks 142-1 are each a plate-shaped block including a bottom surface of a recess portion 16-1. The plurality of blocks 141-1 and the plurality of blocks 142-1 are alternately laminated in the Y direction, and are fixed to each other by fusion, adhesion, or bolt fastening. The recess portions 16-1 are each defined by two blocks 141-1 and one block 142-1 interposed therebetween. To be noted, the opening side of the recess portions 16-1 may be rounded.

By using a plurality of blocks in combination, the punch 14-1 including at least two pressing portions 15-1 and at least one recess portion 16-1 can be easily formed.

A punch 14-2 of a modification example illustrated in FIG. 8B is constituted by a plurality of blocks 141-2, a plurality of blocks 142-2, and a plurality of blocks 143-2 laminated in the Y direction. The blocks 141-2, 142-2, and 143-2 are each formed from metal.

The blocks 141-2 are each a block including a pressing portion 15-2. The blocks 143-2 are each a plate whose distal end portion is bent. Recess portions 16-2 are each defined by two blocks 143-2 bent in opposite directions among the plurality of blocks 143-2. The blocks 142-2 are blocks that are provided for adjusting the positions of the recess portions 16-2 and the pressing portions 15-2. One recess portion 16-2 is defined between two pressing portions 15-2 by two blocks 143-2 being interposed between two blocks 142-2 and two blocks 141-2.

In the case of increasing the width of the recess portion 16-2, an unillustrated interval adjusting block may be provided between the two blocks 143-2. The plurality of blocks 141-2, 142-2, and 143-2 laminated in the Y direction are fixed to each other by fusion, adhesion, bolt fastening, or the like.

By using the plurality of blocks 141-2, 142-2, and 143-2 in combination, the punch 14-2 including at least two pressing portions 15-2 and at least one recess portion 16-2 can be easily formed. In addition, the inclination angle of the inclined surfaces of the recess portion 16-2 can be easily set by setting the bending angle of the two blocks 142-2.

As described above, since the punches 14-1 and 14-2 illustrated in FIGS. 8A and 8B can be formed by appropriately combining blocks, the positions of the recess portions and the like can be flexibly changed.

To be noted, although the number of the recess portions 16 of the punch 14 illustrated in FIG. 2B is equal to the number of the projection portions 13 of the processing target material W1, the configuration is not limited to this. The number of recess portions in a punch may be any number as long as the number is equal to or larger than the number of projection portions of the processing target material. That is, the number of the pressing portions of the punch may be any number as long as the number is equal to or larger than the number of groove portions of the processing target material. A case where the number of the recess portions of the punch is larger than the number of the projection portions 13 of the processing target material W1, that is, a case where the number of the pressing portions of the punch is larger than the number of the groove portions 12 of the processing target material W1 will be described below.

Figure 9A:
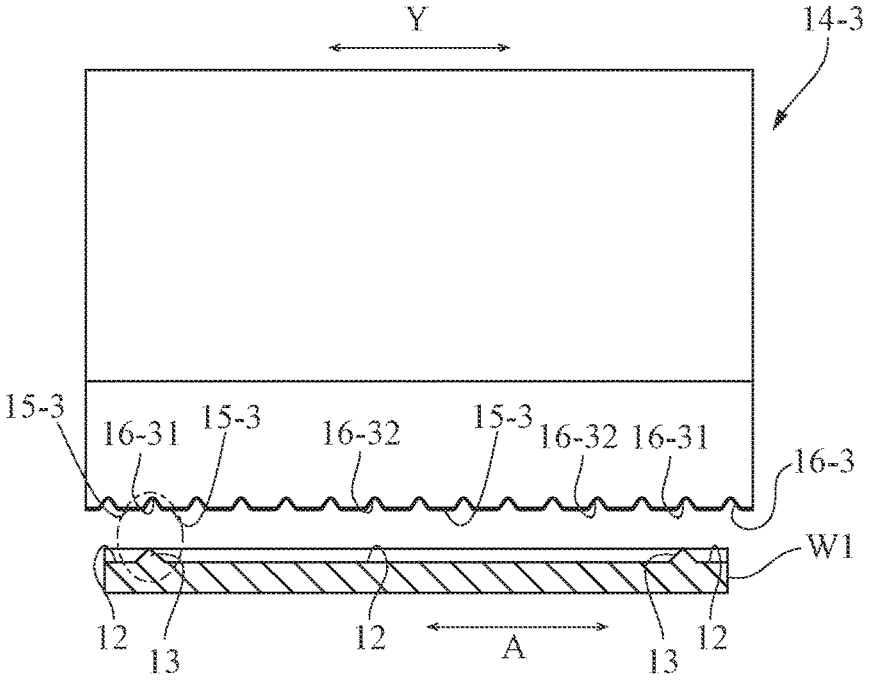
FIG. 9A is an explanatory diagram of a punch of a modification example.
Figure 9B:
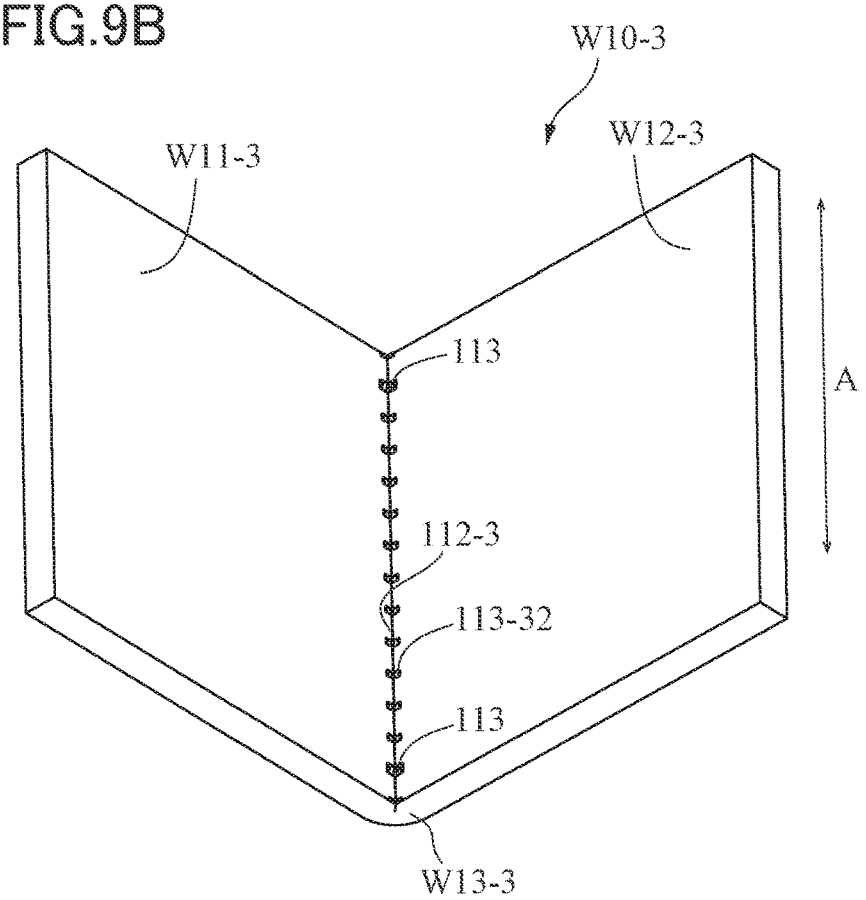
FIG. 9B is a perspective view of a product of a modification example.

FIG. 9A is an explanatory diagram of a punch 14-3 of a modification example. FIG. 9B is a perspective view of a product W10-3 of the modification example. FIG. 9A illustrates a side view of the punch 14-3 and a section view of the processing target material W1 for description. As illustrated in FIG. 9A, the punch 14-3 includes a plurality of recess portions 16-3 of a number larger than the number of the projection portions 13 of the processing target material W1. In addition, the plurality of recess portions 16-3 are arranged at intervals in the Y direction. The interval between each pair of adjacent recess portions 16-3 among the plurality of recess portions 16-3 may be all equal, partially equal, or all different, and may be appropriately set in accordance with the type of the product to be manufactured. In the example of FIG. 9A, the interval between each pair of the adjacent recess portions 16-3 among the plurality of recess portions 16-3 is all equal. By bending the processing target material W1 by using the punch 14-3, the product W10-3 illustrated in FIG. 9B is manufactured.

By using the punch 14-3, a processing target material having different dimensions or a different shape from the processing target material W1 can be also bent. In this case, in the punch 14-3, a recess portion 16-3 that is to be used for engagement with a projection portion is selected from the plurality of recess portions 16-3 in accordance with the projection portion of the processing target material to be bent. Therefore, a processing target material having a different length of the planned bending region from the processing target material W1 can be bent by using the same punch 14-3 and the same die. In addition, the bending process can be also performed by using the same punch 14-3 and the same die in the case of changing the position of the processing target material in the Y direction with respect to the die. As described above, the same punch 14-3 and the same die can be used for the bending process of various processing target materials.

In addition, the punch 14-3 includes a plurality of pressing portions 15-3 arranged at intervals in the Y direction. The recess portions 16-3 are each disposed between two adjacent pressing portions 15-3 among the plurality of pressing portions 15-3. The number of the plurality of recess portions 16-3 is smaller than the number of the plurality of pressing portions 15-3 by 1. Two or more of the plurality of pressing portions 15-3 engage with one groove portion 12.

Since the number of the recess portions 16-3 of the punch 14-3 is larger than the number of the projection portions 13 of the processing target material W1, the plurality of recess portions 16-3 includes recess portions 16-31 used for engagement with the projection portions 13 of the processing target material W1 during the bending process, and recess portions 16-32 that are not used in the engagement with the projection portions 13.

Description will be given focusing on a part circled by a one-dot chain line in FIG. 9A. The part circled by the one-dot chain line includes one projection portion 13, and one recess portion 16-31 that engages with the one projection portion 13. The projection portion 13 is provided between two groove portions 12 extending in the A direction. The recess portion 16-31 is provided between two pressing portions 15-3 extending in the Y direction.

By bending the processing target material W1 by using the punch 14-3 and an unillustrated die, the product W10-3 illustrated in FIG. 9B can be obtained. The product W10-3 includes a portion W11-3 serving as an example of a first portion, a portion W12-3 serving as an example of a second portion, and a bent portion W13-3. The portion W12-3 intersects with the portion W11-3, and the portions W11-3 and W12-3 are interconnected by the bent portion W13-3.

In the state in which the bending process of the processing target material W1 has completed, the groove portions 12 illustrated in FIG. 9A are deformed, and thus the pairs of inclined surfaces of the groove portions 12 are in firm contact with or are close to each other. That is, the bent portion W13-3 has a plurality of slits 112-3 formed by deformation of the plurality of groove portions 12 in the bending inner side of the bent portion W13-3. The plurality of slits 112-3 each linearly extend in the A direction.

In addition, the bent portion W13-3 has a plurality of protrusion portions 113 formed by deformation of the plurality of projection portions 13 on the bending inner side of the bent portion W13-3. The protrusion portions 113 also each serve as a projection portion. The protrusion portions 113 each serve as an example of a first projection portion. Meanwhile, protrusion portions 113-32 are formed at positions corresponding to the recess portions 16-32 that do not engage with the projection portions 13 by the recess portions 16-32 in the bent portion W13-3. The protrusion portions 113-32 are smaller than the protrusion portions 113. The protrusion portions 113-32 serve as an example of second projection portions.

If the protrusion portions 113 and the protrusion portions 113-32 are arranged at equal intervals in the positions corresponding to the slits 112-3 formed from the groove portions 12, it means that the bending process has been performed while the position and orientation of the processing target material W1 with respect to the die is corrected.

As described above, by using the punch 14-3 illustrated in FIG. 9A, the preparation time for the punch 14-3 and the die can be shortened, and the productivity of the bending process of the product can be improved.

Figure 10A:
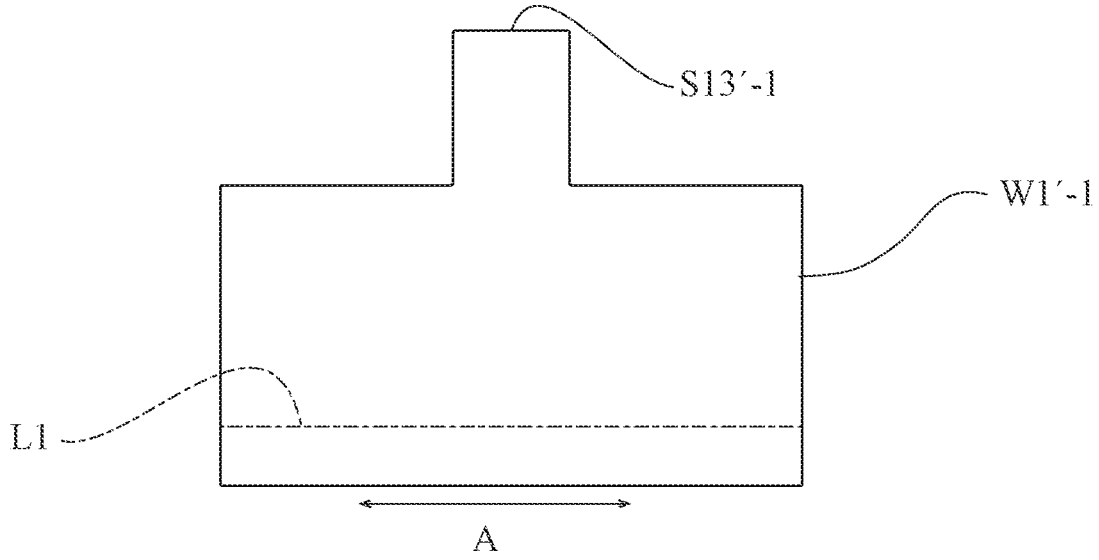
FIG. 10A is a plan view of a base material of a modification example.
Figure 10B:
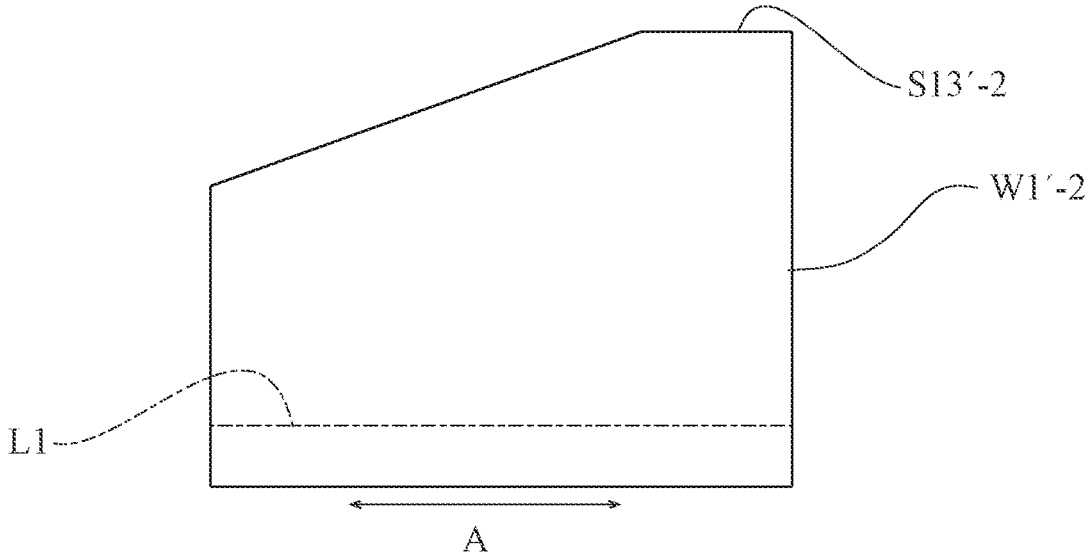
FIG. 10B is a plan view of a base material of a modification example.

In addition, the shape of the base material W1' used for forming the processing target material W1 is not limited to the rectangular shape as illustrated in FIG. 4A. FIG. 10A is a plan view of a base material W1'-1 of a modification example. FIG. 10B is a plan view of a base material W1'-2 of a modification example. As illustrated in FIG. 10A, in the base material W1'-1, the width of an end surface S13'-1 that abuts the backgauge 106 in the base material W1'-1 is small. In addition, as illustrated in FIG. 10B, in the base material W1'-2, the width of an end surface S13'-2 that abuts the backgauge 106 in the base material W1'-2 is small. Since the end surfaces S13'-1 and S13'-2 are narrow, the processing target material is more likely to be displaced from the die. As described above, the position and orientation of the processing target material can be corrected even in the case of a processing target material having such a shape as to be likely to be displaced with respect to the die.

Second Embodiment

Figure 11A:
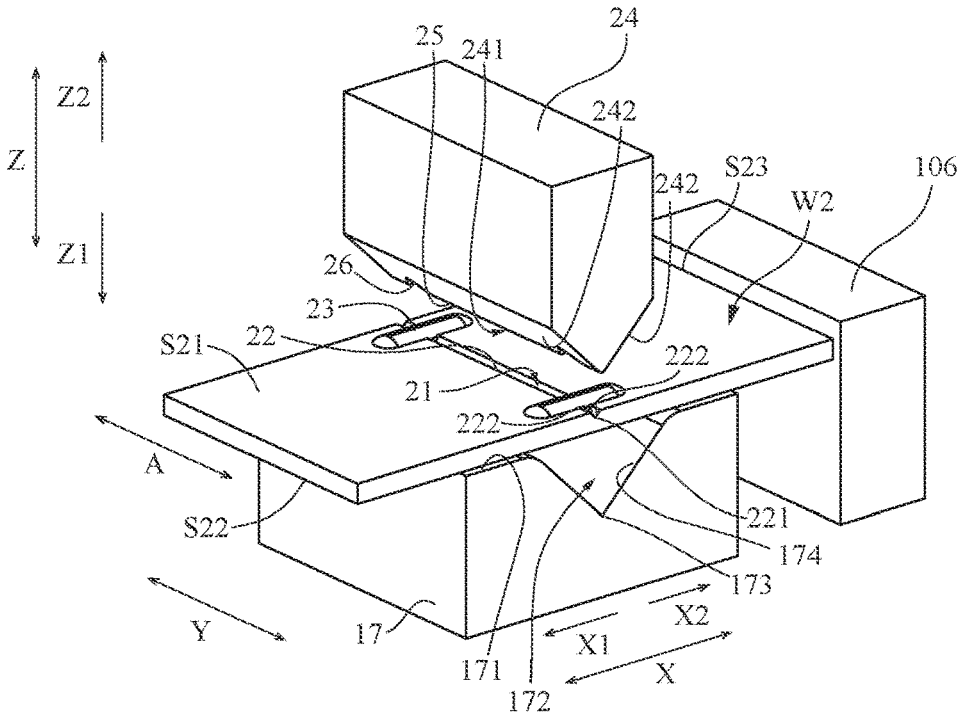
FIG. 11A is a perspective view of a punch, a die, and a processing target material according to a second embodiment.

A second embodiment will be described. FIG. 11A is a perspective view of a punch 24, the die 17, and a processing target material W2 according to the second embodiment. FIG. 11A illustrates a state in which the processing target material W2 is placed on the die 17. In the second embodiment, in the manufacturing system 1000 illustrated in FIG. 1 described in the first embodiment, the punch 24 and the processing target material W2 illustrated in FIG. 11A are used in place of the punch 14 and the processing target material W1. The other elements than the punch 24 and the processing target material W2 are the same as in the first embodiment. In the second embodiment, elements substantially the same as in the first embodiment will be denoted by the same reference signs, and detailed description thereof will be omitted.

The processing target material W2 is a plastically deformable member such as a metal member or a plastic member. The processing target material W2 is preferably a metal member such as a metal plate.

The punch 24 serves as a first punch. In the second embodiment, the punch 24 and the processing target material W2 are formed in such shapes that the position and orientation of the processing target material W2 are corrected in accordance with the punch 24 when the descending punch 24 comes into contact with the processing target material W2. The configuration of the punch 24 and the processing target material W2 of the second embodiment will be described in detail below.

Figure 11B:
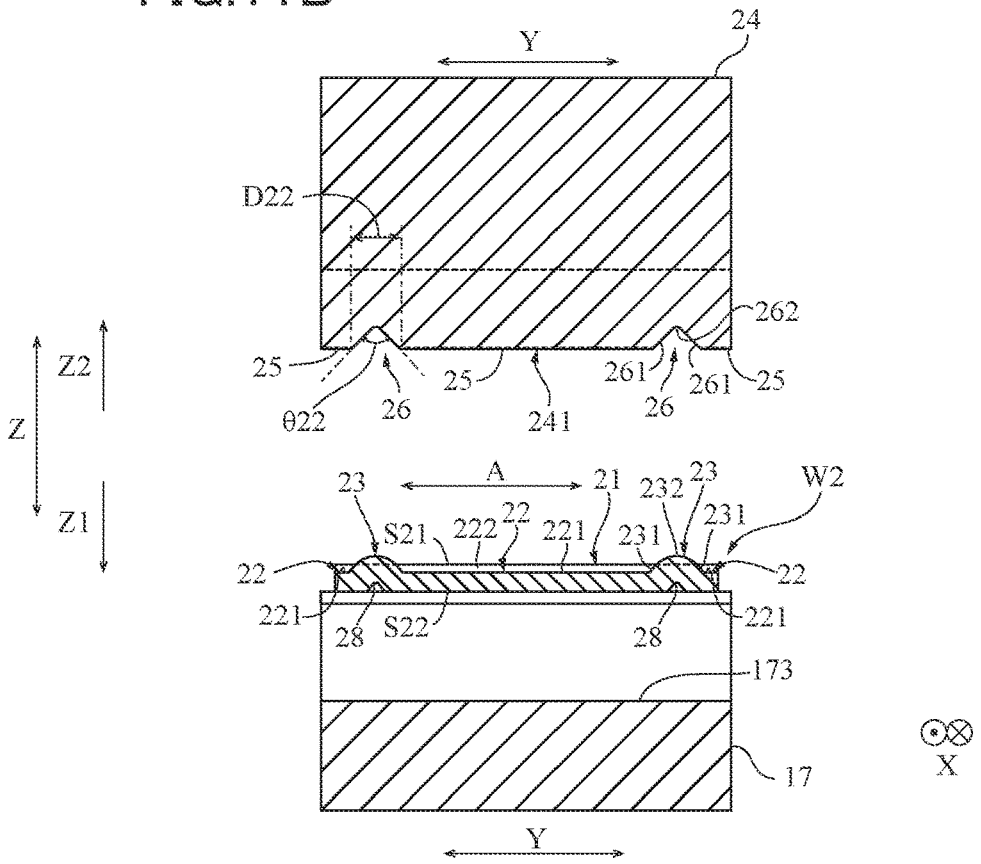
FIG. 11B is a section view of the punch, die, and processing target material according to the second embodiment.

FIG. 11B is a section view of the punch 24, the die 17, and the processing target material W2. Specifically, FIG. 11B illustrates the cross-section of the punch 24, the die 17, and the processing target material W2 including the bottom portion 173 of the groove portion 172 in the die 17 taken along a Y-Z plane extending in the Y direction and the Z direction as viewed in the X direction.

The processing target material W2 includes a surface S21, and a surface S22 opposite to the surface S21. The processing target material W2 serving as a bending target object of the second embodiment has a different configuration from the processing target material W1X illustrated in FIG. 19A serving as a bending target object of the comparative example. The processing target material W2 includes a guiding portion 21 formed on the surface S21. The guiding portion 21 extends in the A direction in the surface S21. The punch 24 includes a distal end portion 241 projecting in the Z1 direction in a V shape as viewed in the Y direction. The distal end portion 241 extends in the Y direction in a lower portion of the punch 24. The distal end portion 241 of the punch 24 descending in the Z1 direction comes into contact with the guiding portion 21 of the processing target material W2, and thus the position and orientation of the processing target material W2 are corrected such that the guiding portion 21 engages with the distal end portion 241.

The guiding portion 21 of the processing target material W2 includes a plurality of, for example, three groove portions 22 defined in the surface S21, and a plurality of, for example, two projection portions 23 formed on the surface S21. Recess portions 28 are defined in parts of the surface S22 corresponding to the back side of the projection portions 23 on the surface S21. The groove portions 22 serve as first groove portions. The projection portions 23 of the second embodiment each project with respect to a bottom portion 221 of each of the groove portions 22. The number of the projection portions 23 is smaller than the number of the groove portions 22 by 1. Further, in the surface S21 of the processing target material W2, the groove portions 22 and the projection portions 23 are alternately arranged in the A direction. Here, the A direction serves as a first direction with reference to the processing target material W2.

The plurality of groove portions 22 are each a groove extending in the A direction and a V-shaped groove extending in the A direction in the second embodiment. The plurality of groove portions 22 are arranged at intervals in the A direction. Each projection portion 23 is disposed between two adjacent groove portions 22 among the plurality of groove portions 22.

The groove portions 22 each include a pair of inclined surfaces 222 inclined such that the groove width becomes smaller toward a bottom portion 221 of the groove portion 22. The pair of inclined surfaces 222 extend in the A direction. To be noted, although the groove portions 22 each have a V shape, that is, each have a linear bottom portion 221, the configuration is not limited to this. It suffices as long as the groove portions 22 each have a pair of inclined surfaces 222, and for example, the groove portions 22 may each have a U shape in which the bottom portion 221 is a surface. In this case, the surface of the bottom portion 221 may be, for example, a flat surface or a curved surface. The projection portions 23 are each formed in a tapered shape to project with respect to the bottom portions 221 of the two groove portions 22 between which the projection portion 23 is positioned in the A direction.

In the second embodiment, the punch 24 is a single body formed from metal. As a result of this, the punch 24 can be produced at a low cost. The punch 24 includes a pair of inclined surfaces 242. The inclined surfaces 242 are each formed to extend in the Y direction. The inclined surfaces 242 each extend in a shape tapered in the Z1 direction as viewed in the Y direction. That is, the punch 24 is formed such that the width thereof in the X direction is smaller at a position closer to the distal end portion 241 as viewed in the Y direction.

The distal end portion 241 of the punch 24 includes a plurality of, for example, three pressing portions 25, and a plurality of, for example, two recess portions 26. The recess portions 26 are recessed in the Z2 direction with respect to the pressing portions 25. The recess portions 26 are each defined in a cutout shape as viewed in the X direction. The pressing portions 25 are projection portions as compared with the recess portions 26. In the second embodiment, the number of the pressing portions 25 is equal to the number of the groove portions 22, and the number of the recess portions 26 is equal to the number of the projection portions 23. The number of the recess portions 26 is smaller than the number of the pressing portions 25 by 1. Further, in the distal end portion 241 of the punch 24, the pressing portions 25 and the recess portions 26 are alternately arranged in the Y direction. Here, the Y direction is a predetermined direction, and serves as a second direction with reference to the punch 24. In the second embodiment, the distal end portion 241 of the punch 24 engages with the guiding portion 21 of the processing target material W2 when the punch 24 descends, and thus the position and orientation of the processing target material W2 are corrected such that the A direction of the processing target material W2 matches the Y direction of the punch 24. The distal end portion 241 of the punch 24 engaging with the guiding portion 21 of the processing target material W2 means that the pressing portions 25 engage with the groove portions 22 and the recess portions 26 engage with the projection portions 23.

Each of the plurality of pressing portions 25 is a mountain portion having a V shape which is convex downward and whose ridgeline extends in the Y direction. The distal end of the pressing portion 25, which is the ridgeline of the mountain portion, is preferably rounded. The plurality of pressing portions 25 are arranged at intervals in the Y direction. The recess portions 26 are each disposed between two adjacent pressing portions 25 among the plurality of pressing portions 25.

To be noted, although the processing target material W2 includes the plurality of projection portions 23 in the second embodiment, the configuration is not limited to this, and it suffices as long as at least one projection portion 23 is provided. In addition, it suffices as long as the processing target material W2 has at least two groove portions 22. For example, in the case where the length of a planned bending region of the processing target material W2 in the A direction is 20 mm or less, a configuration in which one projection portion 23 is disposed at the center of the planned bending region of the processing target material W2 and two groove portions 22 are arranged in the A direction such that the one projection portion 23 is interposed therebetween may be employed.

Similarly, although the punch 24 includes the plurality of recess portions 26, the configuration is not limited to this, and it suffices as long as at least one recess portion 26 is provided. In addition, it suffices as long as the punch 24 includes at least two pressing portions 25.

A configuration of the projection portions 23 of the processing target material W2 and the recess portions 26 of the punch 24 will be described in further detail.

The projection portion 23 of the processing target material W2 includes a pair of inclined surfaces 231 and a distal end portion 232. The inclined surfaces 231 each serve as a first inclined surface. The pair of inclined surfaces 231 are inclined in a shape tapered from the bottom portion 221 of the corresponding one of the groove portions 22 toward the distal end portion 232. That is, the pair of inclined surfaces 231 are inclined such that the width of the projection portion 23 in the A direction becomes larger from the distal end portion 232 of the projection portion 23 toward the bottom portion 221 of the corresponding one of the groove portions 22.

The recess portions 26 of the punch 24 each include a pair of inclined surfaces 261 and a bottom portion 262. The inclined surfaces 261 each serve as a second inclined surface. The pair of inclined surfaces 261 are inclined in a shape tapered toward the bottom portion 262 of the recess portion 26. That is, the pair of inclined surfaces 261 are inclined such that the width of the recess portion 26 in the Y direction becomes smaller from corresponding one of the pressing portions 25 toward the bottom portion 262.

Each step of a manufacturing method for a product according to the second embodiment will be described below. First, a step of forming the processing target material W2 illustrated in FIGS. 11A and 11B from the base material W1' illustrated in FIG. 4A will be described. FIGS. 12A to 12D are each an explanatory diagram of the step of forming the processing target material W2 from the base material W1'.

Figure 12A:
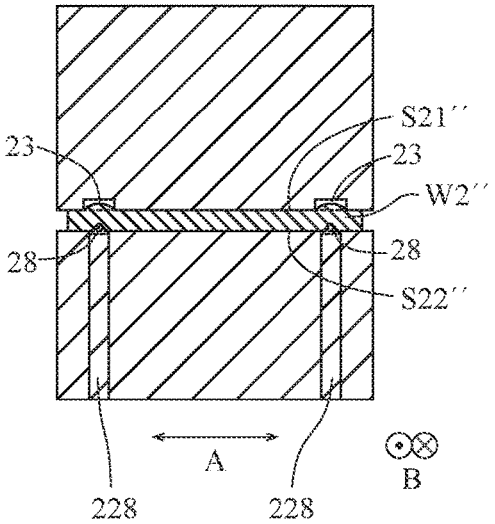
FIG. 12A is an explanatory diagram of a manufacturing method according to the second embodiment.
Figure 12B:
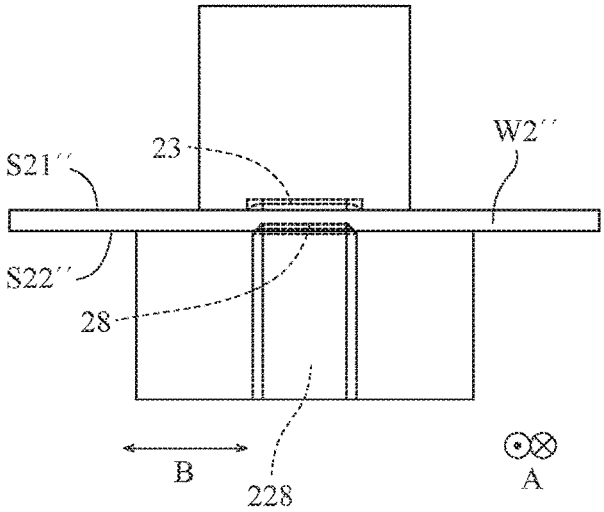
FIG. 12B is an explanatory diagram of the manufacturing method according to the second embodiment.
Figure 12C:
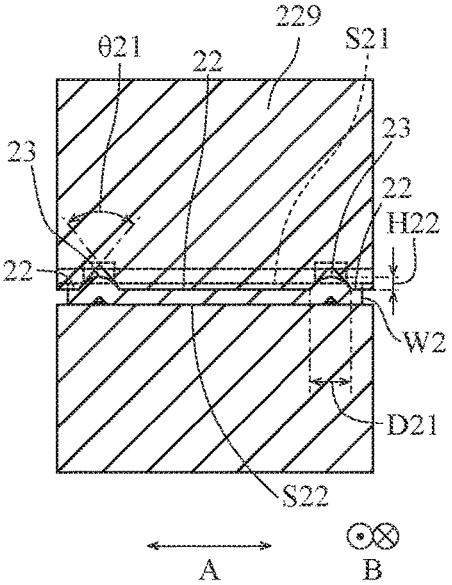
FIG. 12C is an explanatory diagram of the manufacturing method according to the second embodiment.
Figure 12D:
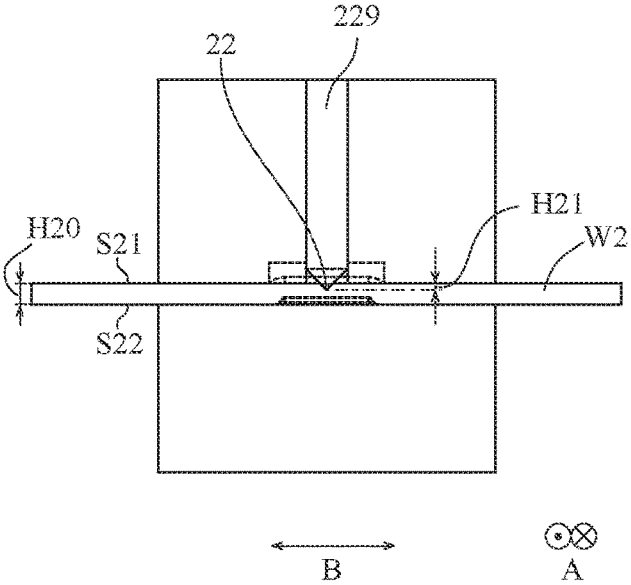
FIG. 12D is an explanatory diagram of the manufacturing method according to the second embodiment.

In the second embodiment, the processing target material W2 including the guiding portion 21 is formed by processing the base material W1' by two steps. FIGS. 12A and 12B are each an explanatory diagram of the first step, and FIGS. 12C and 12D are each an explanatory diagram of the second step. FIGS. 12A and 12C are each a section view, and FIGS. 12B and 12D are each a side view. The projection portions 23 are formed in the first step, and the groove portions 22 are formed in the second step.

First, a punch 228 illustrated in FIGS. 12A and 12B is pressed against the surface S12' of the base material W1' illustrated in FIG. 4A to form the projection portions 23. As a result of this, a base material W2" serving as an intermediate member including the projection portions 23 is formed. The punch 228 serves as a third punch. A surface S21" of the base material W2" corresponds to the surface S11' of the base material W1'. A surface S22" of the base material W2" corresponds to the surface S12' of the base material W1'. On the surface S12' opposite to the surface S11' on which the projection portions 23 are formed, the recess portions 28 are formed by the punch 228 at positions corresponding to the projection portions 23. The projection portions 23 and the recess portions 28 extend in a B direction that is a longitudinal direction intersecting with the A direction considering the A direction as a short-side direction. That is, the projection portions 23 and the recess portions 28 are longer in the B direction than in the A direction. In the second embodiment, the B direction is a direction perpendicular to the A direction.

Next, a punch 229 illustrated in FIGS. 12C and 12D is pressed against the surface 521" of the base material W2" illustrated in FIGS. 12A and 12B to form the groove portions 22. As a result of this, the processing target material W2 on which each projection portion 23 is formed between two groove portions 22 is manufactured. The punch 229 serves as a fourth punch. In the distal end portion of the punch 229, parts that transfer the groove portions 22 onto the surface S21" are each formed to have a convex V shape in side view. The angle of the distal end portion of the punch 229 is, for example, 90°.

Next, a step of placing the processing target material W2 on the die 17 as illustrated in FIG. 11A is performed by conveying the processing target material W2 to the die 17 by the robot arm 200 illustrated in FIG. 1. In this step, the robot arm 200 causes the end surface S23 of the held processing target material W2 to abut the backgauge 106 positioned at the positioning position. As a result of this, the processing target material W2 is positioned with respect to the die 17. The robot arm 200 releases the processing target material W2, and the backgauge 106 retracts in the X2 direction to the retracted position.

Next, a step of lowering the punch 24 in the Z1 direction and bringing the punch 24 into contact with the processing target material W2 placed on the die 17 is performed. In this step, the distal end portion 241 of the punch 24 is brought into contact with the guiding portion 21 of the processing target material W2. Specifically, the pressing portions 25 of the punch 24 are brought into contact with the groove portions 22 of the processing target material W2, and the recess portions 26 of the punch 24 are brought into contact with the projection portions 23 of the processing target material W2.

Figure 13A:
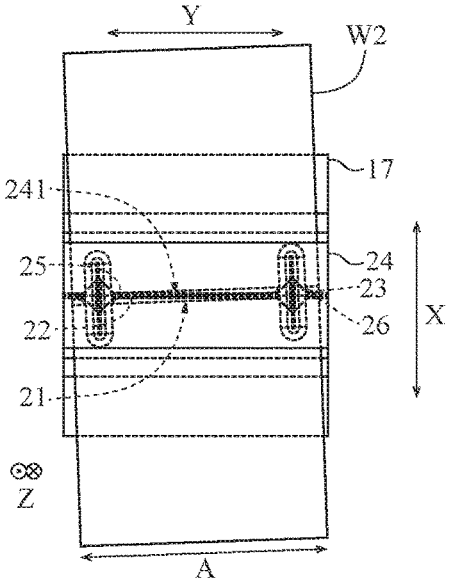
FIG. 13A is an explanatory diagram of the manufacturing method according to the second embodiment.
Figure 13B:
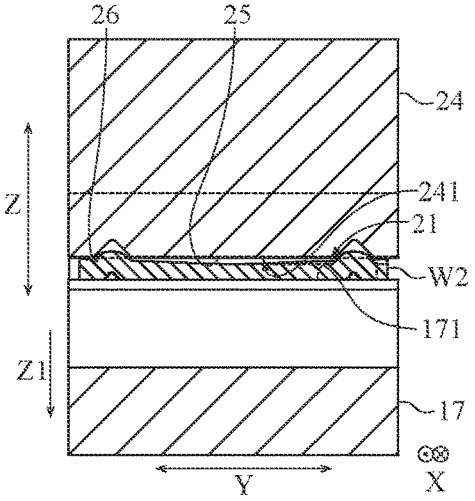
FIG. 13B is an explanatory diagram of the manufacturing method according to the second embodiment.
Figure 13C:
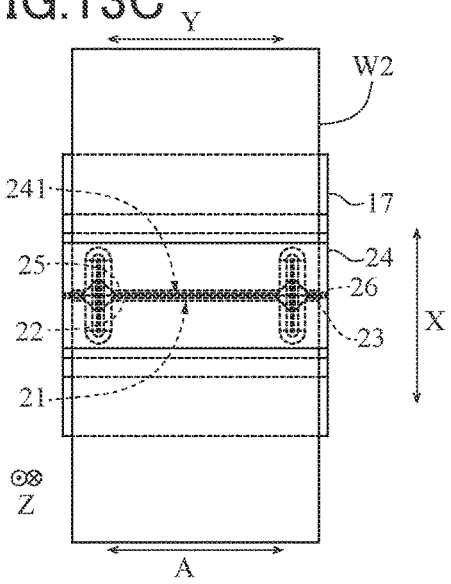
FIG. 13C is an explanatory diagram of the manufacturing method according to the second embodiment.
Figure 13D:
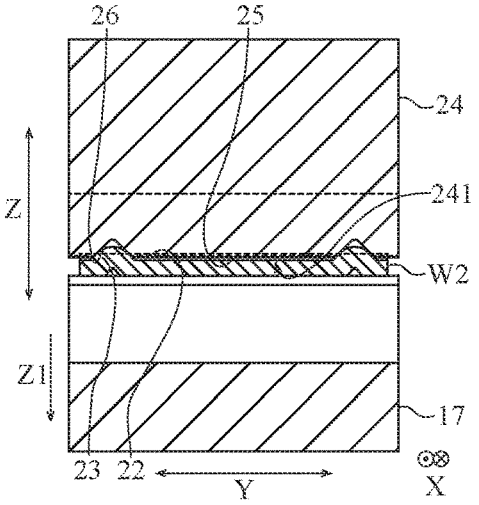
FIG. 13D is an explanatory diagram of the manufacturing method according to the second embodiment.
Figure 13E:
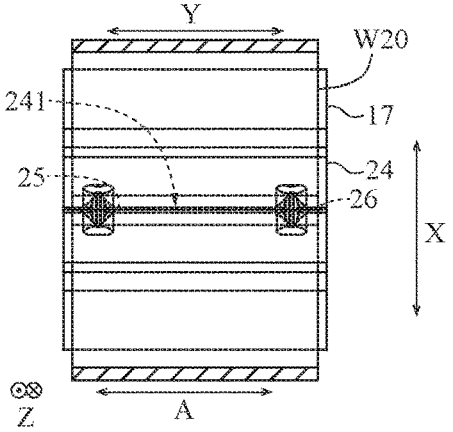
FIG. 13E is an explanatory diagram of the manufacturing method according to the second embodiment.
Figure 13F:
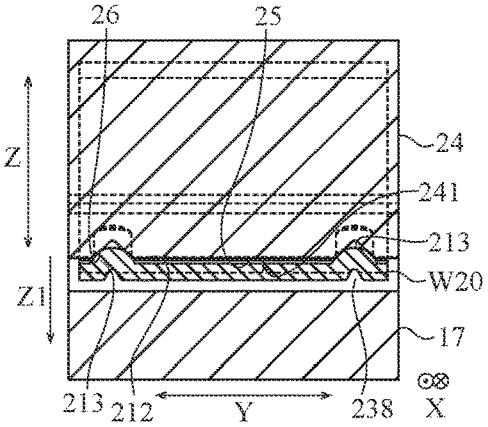
FIG. 13F is an explanatory diagram of the manufacturing method according to the second embodiment.

FIGS. 13A and 13B are explanatory diagrams of the step of bringing the punch 24 into contact with the processing target material W2, and illustrate a moment when the distal end portion 241 of the punch 24 comes into contact with the guiding portion 21 of the processing target material W2. FIGS. 13C and 13D are explanatory diagrams of the step of bringing the punch 24 into contact with the processing target material W2. Specifically, FIGS. 13C and 13D illustrate a state in which the punch 24 has been lowered further from the state illustrated in FIGS. 13A and 13B in which the distal end portion 241 of the punch 24 is brought into contact with the guiding portion 21 of the processing target material W2. FIGS. 13E and 13F are explanatory diagrams of a step of bending the processing target material W2 by pressure from the punch 24, and illustrate a state in which the bending process has been completed. FIGS. 13A, 13C, and 13E are each a top view, and FIGS. 13B, 13D, and 13F are each a section view.

As illustrated in FIGS. 13A and 13B, by lowering the punch 24 in the Z1 direction from the retracted position, the distal end portion 241 of the punch 24 is brought into contact with the guiding portion 21 of the processing target material W2. That is, the pressing portions 25 of the punch 24 are brought into contact with the groove portions 22 of the processing target material W2, and the recess portions 26 of the punch 24 are brought into contact with the projection portions 23 of the processing target material W2. At this time, the pressing portions 25 of the punch 24 press the inclined surfaces 222 of the groove portions 22 illustrated in FIGS. 11A and 11B, and the inclined surfaces 261 of the recess portions 26 of the punch 24 illustrated in FIG. 11B press the inclined surfaces 231 of the projection portions 23.

As a result of this, in the case where the processing target material W2 is in a state of having rotated about the normal line of the placing surface 171 of the die 17 as illustrated in FIGS. 13A and 13B, that is, where the A direction is inclined with respect to the Y direction, a state illustrated in FIGS. 13C and 13D is taken. That is, the orientation of the processing target material W2 is corrected such that the A direction is parallel to the Y direction. In addition, in the case where the processing target material W2 is displaced from the die 17 in the X direction and Y direction, which are horizontal directions, in FIGS. 13A and 13B, the position of the processing target material W2 in the X direction and Y direction is also corrected as illustrated in FIGS. 13C and 13D. To be noted, the position and orientation of the processing target material W2 are corrected in the case where the distal end portion 241 of the punch 24 comes into contact with the entire region of the guiding portion 21 in the A direction, that is, in the case where all the pressing portions 25 of the punch 24 come into contact with the groove portions 22. Here, in the step illustrated in FIGS. 13A to 13D, the processing target material W2 is pressed by the lowered punch 24, but is not deformed or is only slightly warped.

When the punch 24 is further lowered in the Z1 direction from the state illustrated in FIGS. 13C and 13D, the distal end portion 241 of the punch 24 presses the processing target material W2. As a result of this, the processing target material W2 starts bending by plastic deformation.

As the bending process of the processing target material W2 progresses, the groove portions 22 are deformed and retracted from the pressing portions 25, and the projection portions 23 are deformed and flow to the recess portions 26. That is, the material of the projection portions 23 of the processing target material W2 flows to the bending inner side and into the recess portions 26 of the punch 24. As a result of this, the displacement of the processing target material W2 in the Y direction is corrected also during the bending process of the processing target material W2. That is, although the pressing portions 25 are disengaged from the groove portions 22 during the bending process of the processing target material W2, the recess portions 26 are engaged with the deformed projection portions 23, and therefore the displacement of the processing target material W2 in the Y direction can be suppressed.

According to the operation described above, for example, even if the processing target material W2 is displaced from the die 17 by about 0.2 mm in the Y direction when the processing target material W2 is placed on the die 17, the displacement of the processing target material W2 in the Y direction can be suppressed to 0.02 mm or less during the bending process of the processing target material W2.

The punch 24 is lowered in the Z1 direction from above the processing target material W2 until the processing target material W2 comes into contact with the pair of inclined surfaces 174 of the groove portion 172 of the die 17 illustrated in FIG. 11A to press the processing target material W2 by the punch 24, and thus the processing target material W2 is plastically deformed. Then, the bending process of the processing target material W2 is completed as illustrated in FIGS. 13E and 13F, and thus the product W20 is formed. According to the second embodiment, the position and orientation of the processing target material W2 with respect to the die 17 are corrected by the punch 24, and thus the bending process of the processing target material W2 can be performed with high precision. Therefore, the product W20 of high dimensional precision is manufactured.

Figure 14:
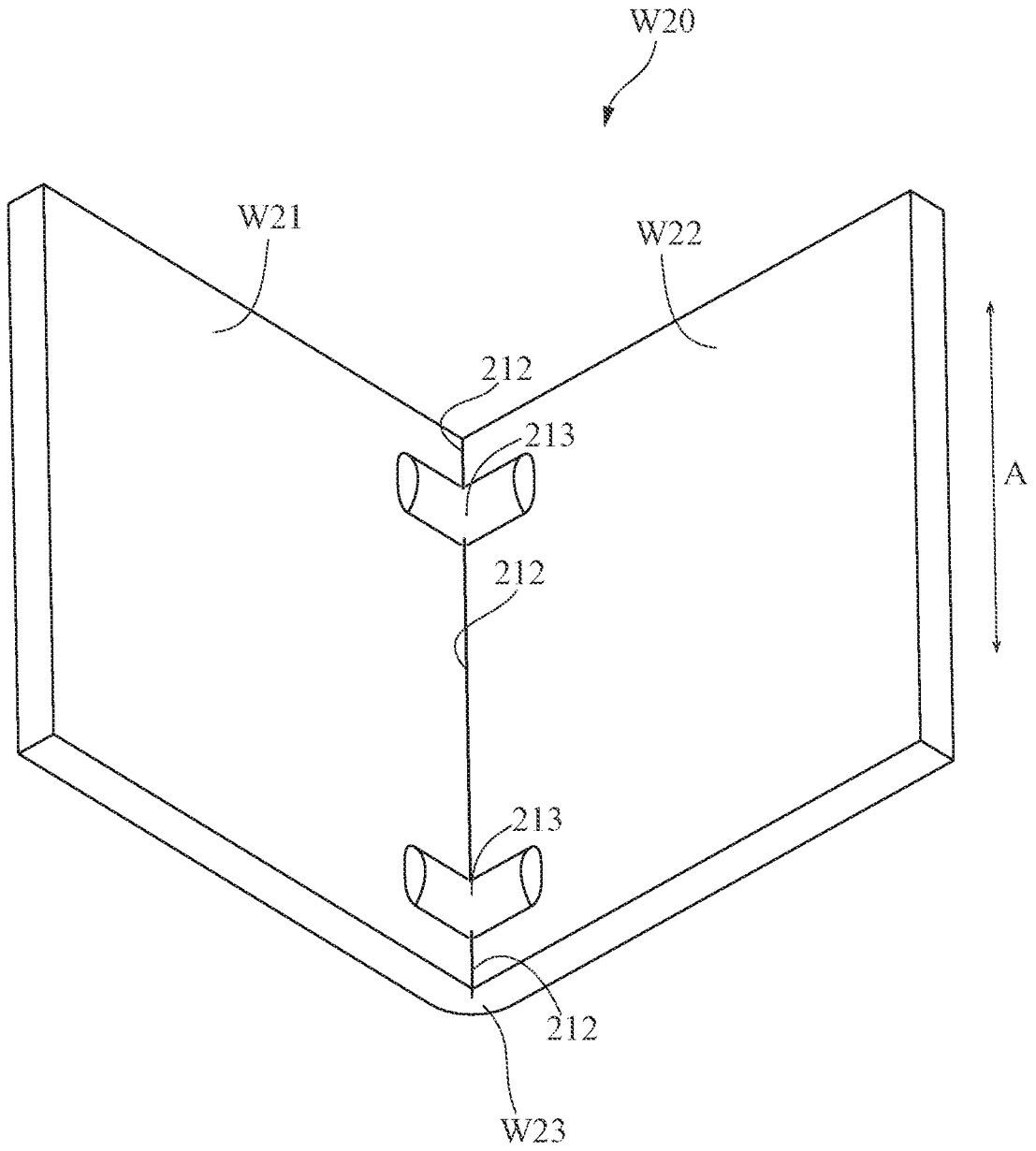
FIG. 14 is a perspective view of a product according to the second embodiment.

FIG. 14 is a perspective view of the product W20 formed by the bending process of the processing target material W2. The product W20 includes a portion W21 serving as an example of a first portion, a portion W22 serving as an example of a second portion, and a bent portion W23. The portion W22 intersects with the portion W21, and the portions W21 and W22 are interconnected by the bent portion W23. The portions W21 and W22 each have, for example, a flat plate shape.

In the state in which the bending process of the processing target material W2 has completed, the groove portions 22 illustrated in FIG. 11A are deformed, and thus the pairs of inclined surfaces 222 of the groove portions 22 are in firm contact with or are close to each other. That is, the bent portion W23 has a plurality of slits 212 formed by deformation of the plurality of groove portions 22 in the bending inner side of the bent portion W23. The slits 212 each correspond to one of the deformed groove portions 22. Therefore, the number of the slits 212 is equal to the number of the groove portions 22. The plurality of slits 212 each linearly extend in the A direction. The plurality of slits 212 are arranged at intervals in the A direction.

In addition, the bent portion W23 has a plurality of protrusion portions 213 formed by deformation of the plurality of projection portions 23 on the bending inner side of the bent portion W23. The protrusion portions 213 also each serve as a projection portion. The protrusion portions 213 each correspond to one of the projection portions 23. Therefore, the number of the protrusion portions 213 is equal to the number of the projection portions 23. The protrusion portions 213 are each disposed between two adjacent slits 212 among the plurality of slits 212. By measuring the positions and angles of the protrusion portions 213 present on the bending inner side of the product W20 with respect to the slits 212 by using image processing, a non-contact laser sensor, or the like, whether the precision of the product W20 is high or low can be determined. In addition, the bent portion W23 includes, on the bending outer side thereof, recess portions 238 illustrated in FIG. 13F formed by deformation of the recess portions 28 illustrated in FIGS. 12A and 12B. The recess portions 238 are formed at positions corresponding to the protrusion portions 213.

Here, a preferable example of the dimensions of the processing target material W2 and the punch 24 will be described with reference to FIGS. 11B, 12C, and 12D.

A depth H21 of each of the groove portions 22 is preferably 0.3 times to 0.5 times of a thickness H20 of the processing target material W2. For example, in the case where the thickness H20 of the processing target material W2 is 1 mm, the depth H21 of the groove portions 22 is preferably 0.3 mm to 0.5 mm. By setting the depth H21 of the groove portions 22 to 0.5 times or less of the thickness H20 of the processing target material W2, breakage of the processing target material W2 at the groove portions 22 when forming the groove portions 22 or during the bending process can be effectively suppressed. In addition, by setting the depth H21 of the groove portions 22 to 0.3 times or more of the thickness H20 of the processing target material W2, the pressing portions 25 of the punch 24 can be reliably engaged with the groove portions 22.

In addition, as viewed in the B direction, an angle θ21 formed by the pair of inclined surfaces 231 of each of the projection portions 23 is preferably 80° to 90°. By setting the angle θ21 to 90° or less, the recess portions 26 of the punch 24 can be reliably engaged with the projection portions 23 of the processing target material W2, and the processing target material W2 can be reliably positioned in the Y direction. In addition, by setting the angle θ21 to 80° or more, the amount of correction of the position of the processing target material W2 in the Y direction possible by the inclined surfaces 231 of the projection portion 23 can be increased.

As viewed in the X direction, an angle θ22 formed by the pair of inclined surfaces 261 of each of the recess portions 26 is preferably 60° to 90°. By setting the angle θ22 of the recess portions 26 to 60° or more, the recess portions 26 can be reliably engaged with the projection portions 23. In addition, by setting the angle θ22 of the recess portions 26 to 90° or less, the deformed projection portions 23 can effectively flow to the recess portions 26 during the bending process of the processing target material W2, and thus displacement of the processing target material W2 in the Y direction can be effectively suppressed.

The width D21 of each of the projection portions 23 is the width of the widest portion of the projection portion 23 in the A direction. The width D22 of each of the recess portions 26 is the width of the widest portion of the recess portion 26 in the Y direction. The width D22 of the recess portion 26 in the Y direction is preferably 0.9 times to 1 time of the width D21 of the projection portion 23 in the A direction. By setting the width D22 of the recess portion 26 to be equal to or less than the width D21 of the projection portion 23, the recess portions 26 can be reliably engaged with the projection portions 23. In addition, by setting the width D22 of the recess portion 26 to 0.9 times or more of the width D21 of the projection portion 23, the amount of correction in which displacement of the processing target material W2 in the Y direction can be corrected when the recess portions 26 engage with the projection portions 23 can be increased.

The height H22 of the projection portions 23 is larger than the depth H21 of the groove portions 22. That is, the projection portions 23 project in the normal line direction of the surface S21 with respect to the surface S21. The amount of projection thereof is preferably 0.5 mm to 1 mm. The width D21 of each of the projection portions 23 is preferably 2 mm to 3 mm.

To be noted, the configuration of the punch 24 of the second embodiment is not limited to the configuration described above, and the punch 24 may be configured like modification examples illustrated in FIGS. 8A, 8B, and 9A and described in the first embodiment. The base material W1' may be also configured like modification examples illustrated in FIGS. 10A and 10B.

Third Embodiment

Figure 15A:
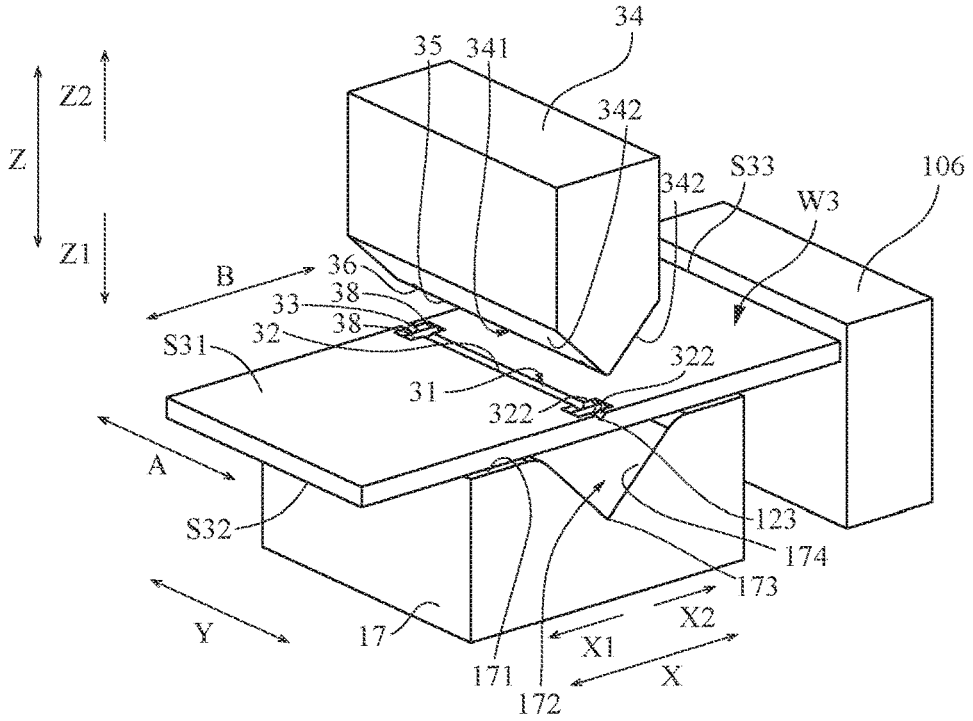
FIG. 15A is a perspective view of a punch, a die, and a processing target material according to a third embodiment.

A third embodiment will be described. FIG. 15A is a perspective view of a punch 34, the die 17, and a processing target material W3 according to the third embodiment. FIG. 15A illustrates a state in which the processing target material W3 is placed on the die 17. In the third embodiment, in the manufacturing system 1000 illustrated in FIG. 1 described in the first embodiment, the punch 34 and the processing target material W3 illustrated in FIG. 15A are used in place of the punch 14 and the processing target material W1. The other elements than the punch 34 and the processing target material W3 are the same as in the first embodiment. In the third embodiment, elements substantially the same as in the first embodiment will be denoted by the same reference signs, and detailed description thereof will be omitted.

The processing target material W3 is a plastically deformable member such as a metal member or a plastic member. The processing target material W3 is preferably a metal member such as a metal plate.

The punch 34 serves as a first punch. In the third embodiment, the punch 34 and the processing target material W3 are formed in such shapes that the position and orientation of the processing target material W3 are corrected in accordance with the punch 34 when the descending punch 34 comes into contact with the processing target material W3. The configuration of the punch 34 and the processing target material W3 of the third embodiment will be described in detail below.

Figure 15B:
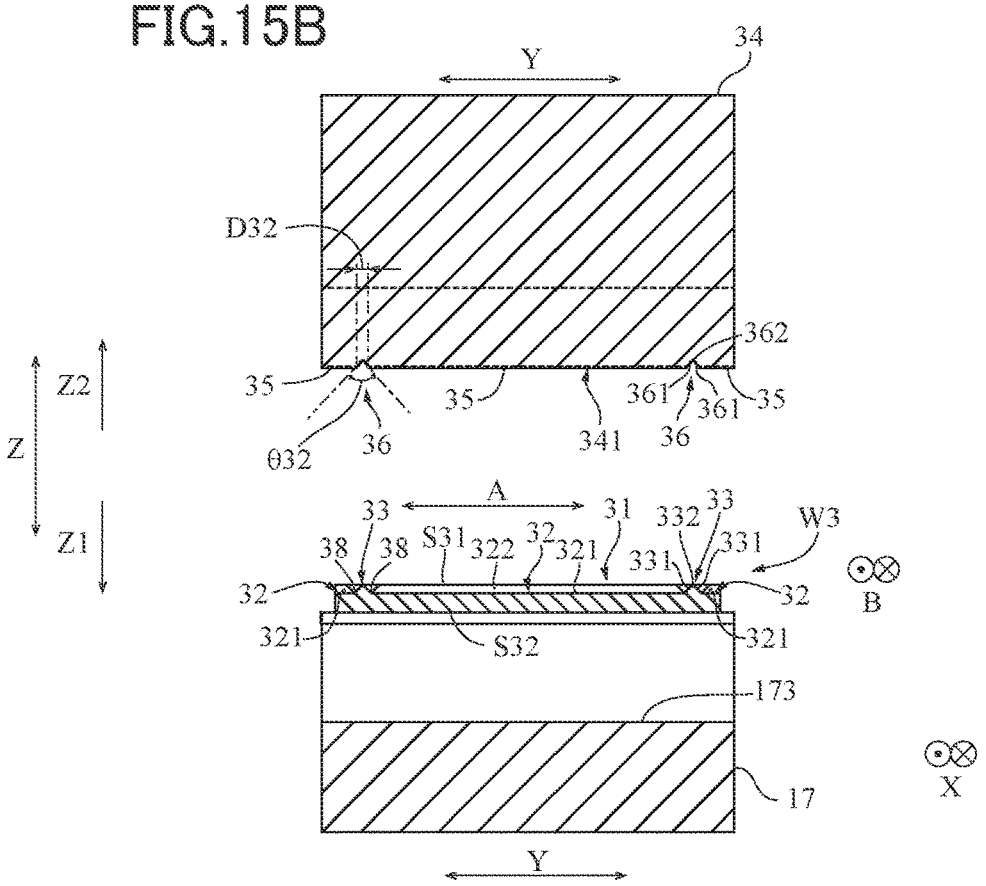
FIG. 15B is a section view of the punch, die, and processing target material according to the third embodiment.

FIG. 15B is a section view of the punch 34, the die 17, and the processing target material W3. Specifically, FIG. 15B illustrates the cross-section of the punch 34, the die 17, and the processing target material W3 including the bottom portion 173 of the groove portion 172 in the die 17 taken along a Y-Z plane extending in the Y direction and the Z direction as viewed in the X direction.

The processing target material W3 includes a surface S31, and a surface S32 opposite to the surface S31. The processing target material W3 serving as a bending target object of the second embodiment has a different configuration from the processing target material W1X illustrated in FIG. 19A serving as a bending target object of the comparative example. The processing target material W3 includes a guiding portion 31 formed on the surface S31. The guiding portion 31 extends in the A direction in the surface S31. The punch 34 includes a distal end portion 341 projecting in the Z1 direction in a V shape as viewed in the Y direction. The distal end portion 341 extends in the Y direction in a lower portion of the punch 34. The distal end portion 341 of the punch 34 descending in the Z1 direction comes into contact with the guiding portion 31 of the processing target material W3, and thus the position and orientation of the processing target material W3 are corrected such that the guiding portion 31 engages with the distal end portion 341.

The guiding portion 31 of the processing target material W3 includes a plurality of, for example, three groove portions 32 defined in the surface S31, and a plurality of, for example, two projection portions 33 formed in the surface S31. Parts of the surface S32 corresponding to the back side of the projection portions 33 on the surface S31 are flat surface. The groove portions 32 serve as first groove portions. The projection portions 33 of the third embodiment each project with respect to a bottom portion 321 of each of the groove portions 32. The number of the projection portions 33 is smaller than the number of the groove portions 32 by 1. Further, in the surface S31 of the processing target material W3, the groove portions 32 and the projection portions 33 are alternately arranged in the A direction. Here, the A direction serves as a first direction with reference to the processing target material W3.

The plurality of groove portions 32 are each a groove extending in the A direction and a V-shaped groove extending in the A direction in the third embodiment. The plurality of groove portions 32 are arranged at intervals in the A direction. Each projection portion 33 is disposed between two adjacent groove portions 32 among the plurality of groove portions 32.

The groove portions 32 each include a pair of inclined surfaces 322 inclined such that the groove width becomes smaller toward the bottom portion 321 of the groove portion 32. The pair of inclined surfaces 322 extend in the A direction. To be noted, although the groove portions 32 each have a V shape, that is, each have a linear bottom portion 321, the configuration is not limited to this. It suffices as long as the groove portions 32 each have a pair of inclined surfaces 322, and for example, the groove portions 32 may each have a U shape in which the bottom portion 321 is a surface. In this case, the surface of the bottom portion 321 may be, for example, a flat surface or a curved surface.

The projection portions 33 are each formed in a tapered shape projecting with respect to the bottom portions 321 of the two groove portions 32 between which the projection portion 33 is disposed in the A direction. Here, the projection portions 33 extend in a B direction that is a longitudinal direction intersecting with the A direction considering the A direction as a short-side direction. That is, the projection portions 33 are longer in the B direction than in the A direction. In the third embodiment, the B direction is a direction perpendicular to the A direction. In the third direction, the projection portions 33 are each defined by a pair of groove portions 38 extending in the B direction and arranged at an interval in the A direction. One projection portion 33 is disposed between a pair of groove portions 38. The groove portions 38 serve as second groove portions.

In the third embodiment, the punch 34 is a single body formed from metal. As a result of this, the punch 34 can be produced at a low cost. The punch 34 includes a pair of inclined surfaces 342. The inclined surfaces 342 are each formed to extend in the Y direction. The inclined surfaces 342 each extend in a shape tapered in the Z1 direction as viewed in the Y direction. That is, the punch 34 is formed such that the width thereof in the X direction is smaller at a position closer to the distal end portion 341 as viewed in the Y direction.

The distal end portion 341 of the punch 34 includes a plurality of, for example, three pressing portions 35, and a plurality of, for example, two recess portions 36. The recess portions 36 are recessed in the Z2 direction with respect to the pressing portions 35. The recess portions 36 are each defined in a cutout shape as viewed in the X direction. The pressing portions 35 are projection portions as compared with the recess portions 36. In the third embodiment, the number of the pressing portions 35 is equal to the number of the groove portions 32, and the number of the recess portions 36 is equal to the number of the projection portions 33. The number of the recess portions 36 is smaller than the number of the pressing portions 35 by 1. Further, in the distal end portion 341 of the punch 34, the pressing portions 35 and the recess portions 36 are alternately arranged in the Y direction. Here, the Y direction is a predetermined direction, and serves as a second direction with reference to the punch 34. In the third embodiment, the distal end portion 341 of the punch 34 engages with the guiding portion 31 of the processing target material W3 when the punch 34 descends, and thus the position and orientation of the processing target material W3 is corrected such that the A direction of the processing target material W3 matches the Y direction of the punch 34. The distal end portion 341 of the punch 34 engaging with the guiding portion 31 of the processing target material W3 means that the pressing portions 35 engage with the groove portions 32 and the recess portions 36 engage with the projection portions 33.

Each of the plurality of pressing portions 35 is a mountain portion having a V shape which is convex downward and whose ridgeline extends in the Y direction. The distal end of the pressing portion 35, which is the ridgeline of the mountain portion, is preferably rounded. The plurality of pressing portions 35 are arranged at intervals in the Y direction. The recess portions 36 are each disposed between two adjacent pressing portions 35 among the plurality of pressing portions 35.

To be noted, although the processing target material W3 includes the plurality of projection portions 33 in the third embodiment, the configuration is not limited to this, and it suffices as long as at least one projection portion 33 is provided. In addition, it suffices as long as the processing target material W3 has at least two groove portions 32. For example, in the case where the length of a planned bending region of the processing target material W3 in the A direction is 20 mm or less, a configuration in which one projection portion 33 is disposed at the center of the planned bending region of the processing target material W3 and two groove portions 32 are arranged in the A direction such that the one projection portion 33 is interposed therebetween may be employed.

Similarly, although the punch 34 includes the plurality of recess portions 36, the configuration is not limited to this, and it suffices as long as at least one recess portion 36 is provided. In addition, it suffices as long as the punch 34 includes at least two pressing portions 35.

A configuration of the projection portions 33 of the processing target material W3 and the recess portions 36 of the punch 34 will be described in further detail.

The projection portions 33 of the processing target material W3 each include a pair of inclined surfaces 331 and a distal end portion 332. The inclined surfaces 331 each serve as a first inclined surface. The pair of inclined surfaces 331 are inclined in a shape tapered from the bottom portion 321 of the corresponding one of the groove portions 32 toward the distal end portion 332. That is, the pair of inclined surfaces 331 are inclined such that the width of the projection portion 33 in the A direction becomes larger from the distal end portion 332 of the projection portion 33 toward the bottom portion 321 of the corresponding one of the groove portions 32.

The recess portions 36 of the punch 34 each include a pair of inclined surfaces 361 and a bottom portion 362. The inclined surfaces 361 each serve as a second inclined surface. The pair of inclined surfaces 361 are inclined in a shape tapered toward the bottom portion 362 of the recess portion 36. That is, the pair of inclined surfaces 361 are inclined such that the width of the recess portion 36 in the Y direction becomes smaller from corresponding one of the pressing portions 35 toward the bottom portion 362.

Each step of a manufacturing method for the product according to the third embodiment will be described below. First, a step of forming the processing target material W3 illustrated in FIGS. 15A and 15B from the base material W1' illustrated in FIG. 4A will be described. FIGS. 16A to 16D are each an explanatory diagram of the step of forming the processing target material W3 from the base material W1'.

Figure 16A:
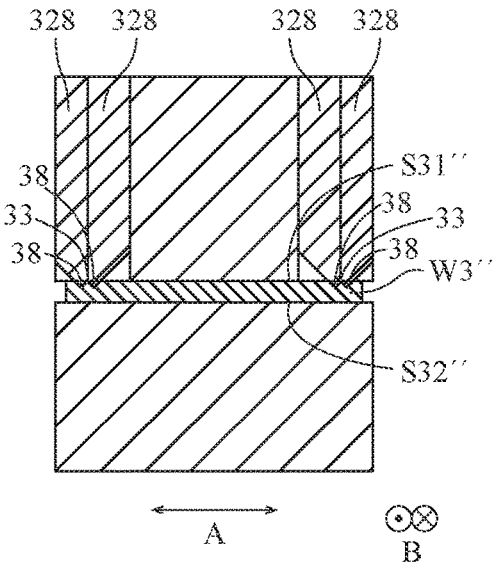
FIG. 16A is an explanatory diagram of a manufacturing method according to the third embodiment.
Figure 16B:
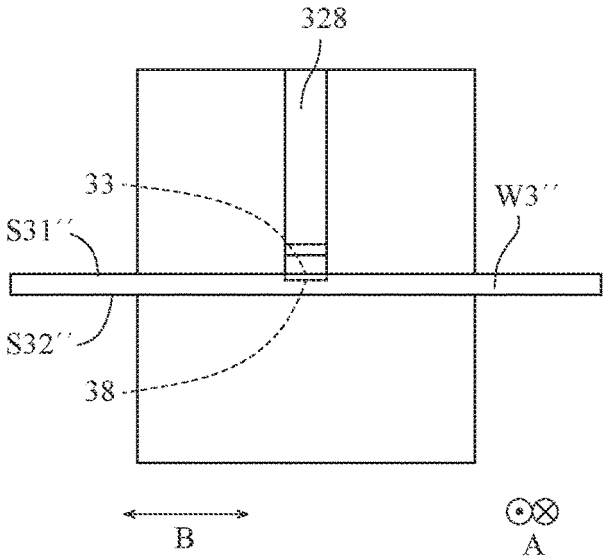
FIG. 16B is an explanatory diagram of the manufacturing method according to the third embodiment.
Figure 16C:
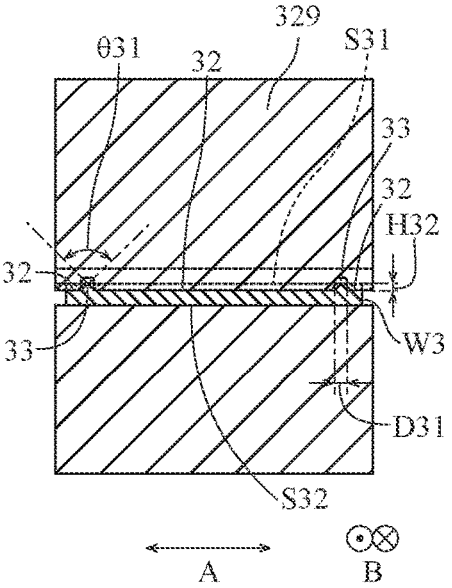
FIG. 16C is an explanatory diagram of the manufacturing method according to the third embodiment.
Figure 16D:
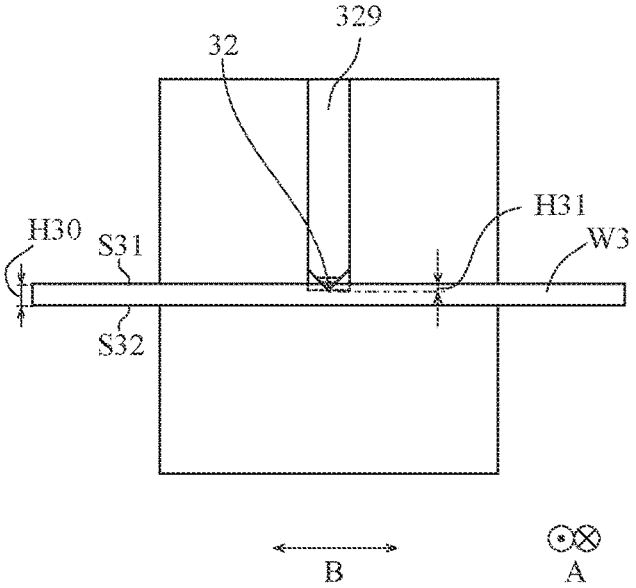
FIG. 16D is an explanatory diagram of the manufacturing method according to the third embodiment.

In the third embodiment, the processing target material W3 including the guiding portion 31 is formed by processing the base material W1' by two steps. FIGS. 16A and 16B are each an explanatory diagram of the first step, and FIGS. 16C and 16D are each an explanatory diagram of the second step. FIGS. 16A and 16C are each a section view, and FIGS. 16B and 16D are each a side view. The projection portions 33 are formed in the first step, and the groove portions 32 are formed in the second step.

First, punches 328 illustrated in FIGS. 16A and 16B is pressed against the surface S11' of the base material W1' illustrated in FIG. 4A to form the groove portions 38. A pair of punches 328 adjacent to each other in the A direction form a pair of groove portions 38 at an interval in the A direction. One pair of groove portions 38 define one projection portion 33. In this first step, a base material W3" that is an intermediate member including the projection portions 33 is formed. The punches 328 each serve as a fifth punch. A surface S31" of the base material W3" corresponds to the surface S11' of the base material W1'. A surface S32" of the base material W3" corresponds to the surface S12' of the base material W1'. The projection portions 33 and the pair of groove portions 38 extend in the B direction. That is, the projection portions 33 are longer in the B direction than in the A direction. In the distal end portion of the punches 328, a portion that transfers the groove portions 38 onto the surface S31" is formed in a convex V shape in side view. The angle of the distal end portion of the punches 328 is, for example, 80° to 90°.

Next, a punch 329 illustrated in FIGS. 16C and 16D is pressed against the surface S31" of the base material W3" illustrated in FIGS. 16A and 16B to form the groove portions 32. As a result of this, the processing target material W3 on which each projection portion 33 is formed between two groove portions 32 is manufactured. The punch 329 serves as a sixth punch. In the distal end portion of the punch 329, parts that transfer the groove portions 32 onto the surface S31" are each formed to have a convex V shape in ide view. The angle of the distal end portion of the punch 329 is, for example, 90°.

Next, a step of placing the processing target material W3 on the die 17 as illustrated in FIG. 15A is performed by conveying the processing target material W3 to the die 17 by the robot arm 200 illustrated in FIG. 1. In this step, the robot arm 200 causes the end surface S33 of the held processing target material W3 to abut the backgauge 106 positioned at the positioning position. As a result of this, the processing target material W3 is positioned with respect to the die 17. The robot arm 200 releases the processing target material W3, and the backgauge 106 retracts in the X2 direction to the retracted position.

Next, a step of lowering the punch 34 in the Z1 direction and bringing the punch 34 into contact with the processing target material W3 placed on the die 17 is performed. In this step, the distal end portion 341 of the punch 34 is brought into contact with the guiding portion 31 of the processing target material W3. Specifically, the pressing portions 35 of the punch 34 are brought into contact with the groove portions 32 of the processing target material W3, and the recess portions 36 of the punch 34 are brought into contact with the projection portions 33 of the processing target material W3.

Figure 17A:
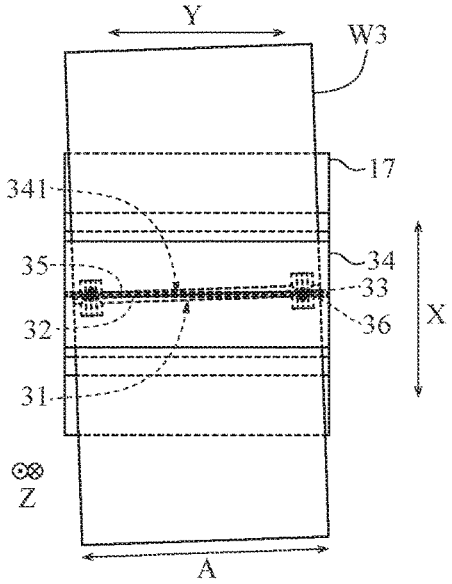
FIG. 17A is an explanatory diagram of the manufacturing method according to the third embodiment.
Figure 17B:
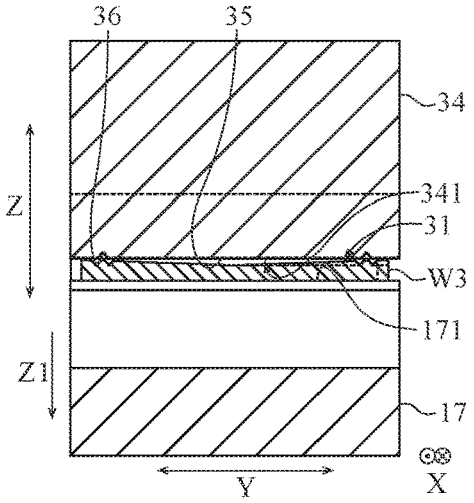
FIG. 17B is an explanatory diagram of the manufacturing method according to the third embodiment.
Figure 17C:
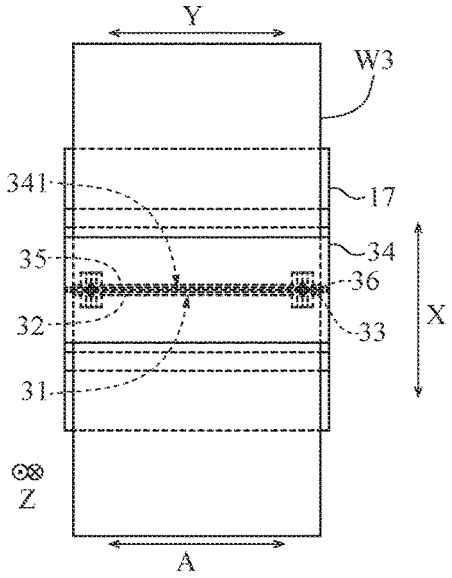
FIG. 17C is an explanatory diagram of the manufacturing method according to the third embodiment.
Figure 17D:
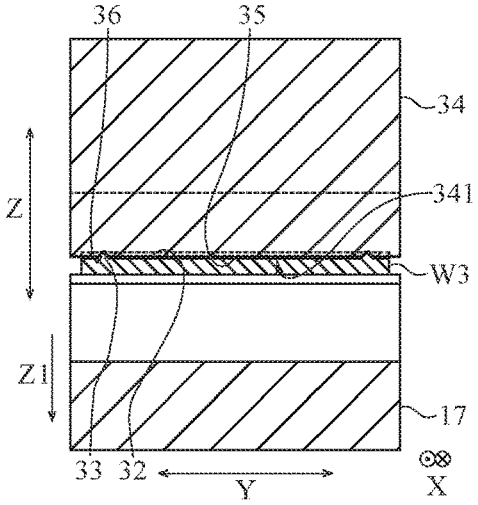
FIG. 17D is an explanatory diagram of the manufacturing method according to the third embodiment.
Figure 17E:
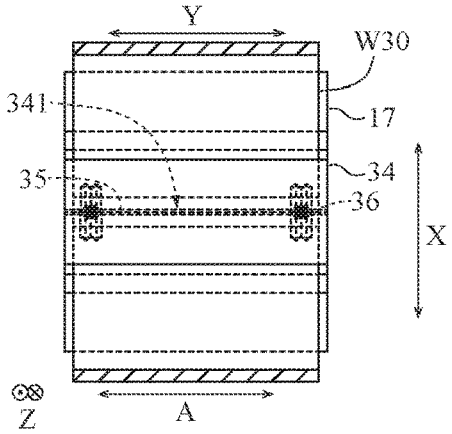
FIG. 17E is an explanatory diagram of the manufacturing method according to the third embodiment.
Figure 17F:
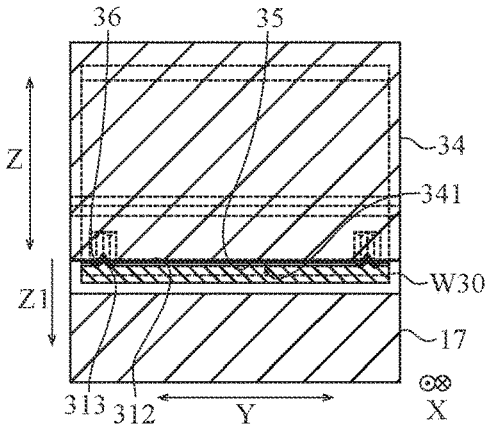
FIG. 17F is an explanatory diagram of the manufacturing method according to the third embodiment.

FIGS. 17A and 17B are explanatory diagrams of the step of bringing the punch 34 into contact with the processing target material W3, and illustrate a moment when the distal end portion 341 of the punch 34 comes into contact with the guiding portion 31 of the processing target material W3. FIGS. 17C and 17D are explanatory diagrams of the step of bringing the punch 34 into contact with the processing target material W3. Specifically, FIGS. 17C and 17D illustrate a state in which the punch 34 has been lowered further from the state illustrated in FIGS. 17A and 17B in which the distal end portion 341 of the punch 34 is brought into contact with the guiding portion 31 of the processing target material W3. FIGS. 17E and 17F are explanatory diagrams of a step of bending the processing target material W3 by pressure from the punch 34, and illustrate a state in which the bending process has been completed. FIGS. 17A, 17C, and 17E are each a top view, and FIGS. 17B, 17D, and 17F are each a section view.

As illustrated in FIGS. 17A and 17B, by lowering the punch 34 in the Z1 direction from the retracted position, the distal end portion 341 of the punch 34 is brought into contact with the guiding portion 31 of the processing target material W3. That is, the pressing portions 35 of the punch 34 are brought into contact with the groove portions 32 of the processing target material W3, and the recess portions 36 of the punch 34 are brought into contact with the projection portions 33 of the processing target material W3. At this time, the pressing portions 35 of the punch 34 press the inclined surfaces 322 of the groove portions 32 illustrated in FIGS. 15A and 15B, and the inclined surfaces 361 of the recess portions 36 of the punch 34 illustrated in FIG. 15B press the inclined surfaces 331 of the projection portions 33.

As a result of this, in the case where the processing target material W3 is in a state of having rotated about the normal line of the placing surface 171 of the die 17 as illustrated in FIGS. 17A and 17B, that is, where the A direction is inclined with respect to the Y direction, a state illustrated in FIGS. 17C and 17D is taken. That is, the orientation of the processing target material W3 is corrected such that the A direction is parallel to the Y direction. In addition, in the case where the processing target material W3 is displaced from the die 17 in the X direction and Y direction, which are horizontal directions, in FIGS. 17A and 17B, the position of the processing target material W3 in the X direction and Y direction is also corrected as illustrated in FIGS. 17C and 17D. To be noted, the position and orientation of the processing target material W3 are corrected in the case where the distal end portion 341 of the punch 34 comes into contact with the entire region of the guiding portion 31 in the A direction, that is, in the case where all the pressing portions 35 of the punch 34 come into contact with the groove portions 32. Here, in the step illustrated in FIGS. 17A to 17D, the processing target material W3 is pressed by the lowered punch 34, but is not deformed or is only slightly warped.

When the punch 34 is further lowered in the Z1 direction from the state illustrated in FIGS. 17C and 17D, the distal end portion 341 of the punch 34 presses the processing target material W3. As a result of this, the processing target material W3 starts bending by plastic deformation.

As the bending process of the processing target material W3 progresses, the groove portions 32 are deformed and retracted from the pressing portions 35, and the projection portions 33 are deformed and flow to the recess portions 36. That is, the material of the projection portions 33 of the processing target material W3 flows to the bending inner side and into the recess portions 36 of the punch 34. As a result of this, the displacement of the processing target material W3 in the Y direction is corrected also during the bending process of the processing target material W3. That is, although the pressing portions 35 are disengaged from the groove portions 32 during the bending process of the processing target material W3, the recess portions 36 are engaged with the deformed projection portions 33, and therefore the displacement of the processing target material W3 in the Y direction can be suppressed.

According to the operation described above, for example, even if the processing target material W3 is displaced from the die 17 by about 0.2 mm in the Y direction when the processing target material W3 is placed on the die 17, the displacement of the processing target material W3 in the Y direction can be suppressed to 0.02 mm or less during the bending process of the processing target material W3.

The punch 34 is lowered in the Z1 direction from above the processing target material W3 until the processing target material W3 comes into contact with the pair of inclined surfaces 174 of the groove portion 172 of the die 17 illustrated in FIG. 15A to press the processing target material W3 by the punch 34, and thus the processing target material W3 is plastically deformed. Then, the bending process of the processing target material W3 is completed as illustrated in FIGS. 17E and 17F, and thus the product W30 is formed. According to the third embodiment, the position and orientation of the processing target material W3 with respect to the die 17 are corrected by the punch 34, and thus the bending process of the processing target material W3 can be performed with high precision. Therefore, the product W30 of high dimensional precision is manufactured.

Figure 18:
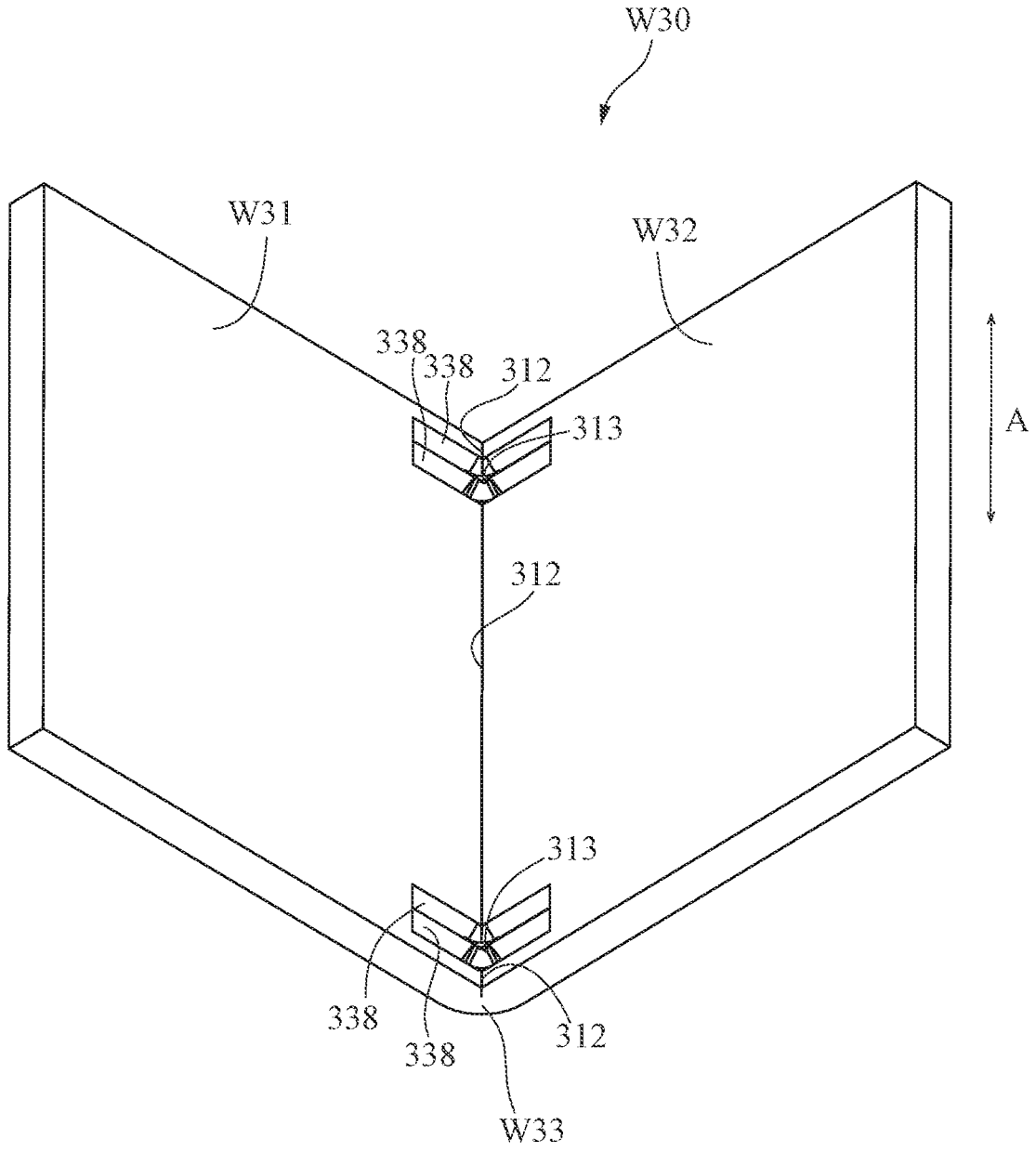
FIG. 18 is a perspective view of a product according to the third embodiment.

FIG. 18 is a perspective view of the product W30 formed by the bending process of the processing target material W3. The product W30 includes a portion W31 serving as an example of a first portion, a portion W32 serving as an example of a second portion, and a bent portion W33. The portion W32 intersects with the portion W31, and the portions W31 and W32 are interconnected by the bent portion W33. The portions W31 and W32 each have, for example, a flat plate shape.

In the state in which the bending process of the processing target material W3 has completed, the groove portions 32 illustrated in FIG. 15A are deformed, and thus the pairs of inclined surfaces 322 of the groove portions 32 are in firm contact with or are close to each other. That is, the bent portion W33 has a plurality of slits 312 formed by deformation of the plurality of groove portions 32 in the bending inner side of the bent portion W33. The slits 312 each correspond to one of the deformed groove portions 32. Therefore, the number of the slits 312 is equal to the number of the groove portions 32. The plurality of slits 312 each linearly extend in the A direction. The plurality of slits 312 are arranged at intervals in the A direction.

In addition, the bent portion W33 has a plurality of protrusion portions 313 formed by deformation of the plurality of projection portions 33 on the bending inner side of the bent portion W33. The protrusion portions 313 also each serve as a projection portion. The protrusion portions 313 each correspond to one of the projection portions 33. Therefore, the number of the protrusion portions 313 is equal to the number of the projection portions 33. The protrusion portions 313 are each disposed between two adjacent slits 312 among the plurality of slits 312. By measuring the positions and angles of the protrusion portions 313 present on the bending inner side of the product W30 with respect to the slits 312 by using image processing, a non-contact laser sensor, or the like, whether the precision of the product W30 is high or low can be determined. The protrusion portions 313 are each formed between a pair of groove portions 338 extending in a direction intersecting with the A direction. The groove portions 338 each correspond to one of the groove portions 38 illustrated in FIG. 16A, and is formed by deformation of the groove portion 38 bent into an L shape.

Here, a preferable example of the dimensions of the processing target material W3 and the punch 34 will be described with reference to FIGS. 15B, 16C, and 16D.

A depth H31 of each of the groove portions 32 is preferably 0.3 times to 0.5 times of a thickness H30 of the processing target material W3. For example, in the case where the thickness H30 of the processing target material W3 is 1 mm, the depth H31 of the groove portions 32 is preferably 0.3 mm to 0.5 mm. By setting the depth H31 of the groove portions 32 to 0.5 times or less of the thickness H30 of the processing target material W3, breakage of the processing target material W3 at the groove portions 32 when forming the groove portions 32 or during the bending process can be effectively suppressed. In addition, by setting the depth H31 of the groove portions 32 to 0.3 times or more of the thickness H30 of the processing target material W3, the pressing portions 35 of the punch 34 can be reliably engaged with the groove portions 32.

A height H32 of each of the projection portions 33 is preferably 1 time to 1.1 times of the depth H31 of the groove portions 32. In addition, as viewed in the B direction, an angle θ31 formed by the pair of inclined surfaces θ31 of each of the projection portions 33 is preferably 80° to 90°. By setting the angle θ31 to 90° or less, the recess portions 36 of the punch 34 can be reliably engaged with the projection portions 33 of the processing target material W3, and the processing target material W3 can be reliably positioned in the Y direction. In addition, by setting the angle θ31 to 80° or more, the amount of correction of the position of the processing target material W3 in the Y direction possible by the inclined surfaces 331 of the projection portion 33 can be increased.

As viewed in the X direction, an angle θ32 formed by the pair of inclined surfaces 361 of each of the recess portions 36 is preferably 60° to 90°. By setting the angle θ32 of the recess portions 36 to 60° or more, the recess portions 36 can be reliably engaged with the projection portions 33. In addition, by setting the angle θ32 of the recess portions 36 to 90° or less, the deformed projection portions 33 can effectively flow to the recess portions 36 during the bending process of the processing target material W3, and thus displacement of the processing target material W3 in the Y direction can be effectively suppressed.

The width D31 of each of the projection portions 33 is the width of the widest portion of the projection portion 33 in the A direction. The width D32 of each of the recess portions 36 is the width of the widest portion of the recess portion 36 in the Y direction. The width D32 of the recess portion 36 in the Y direction is preferably 0.9 times to 1 time of the width D31 of the projection portion 33 in the A direction. By setting the width D32 of the recess portion 36 to be equal to or less than the width D31 of the projection portion 33, the recess portions 36 can be reliably engaged with the projection portions 33. In addition, by setting the width D32 of the recess portion 36 to 0.9 times or more of the width D31 of the projection portion 33, the amount of correction in which displacement of the processing target material W3 in the Y direction can be corrected when the recess portions 36 engage with the projection portions 33 can be increased.

To be noted, the configuration of the punch 34 of the third embodiment is not limited to the configuration described above, and the punch 34 may be configured like modification examples illustrated in FIGS. 8A, 8B, and 9A and described in the first embodiment. The base material W1' may be also configured like modification examples illustrated in FIGS. 10A and 10B.

The product according to the present embodiment can be used as a part of various devices. For example, at least one part constituting a structural member such as a frame of the device or a base of an in-device unit can be the product of the present embodiment. Examples of the device include electronic devices such as computers, imaging devices such as cameras and displays, office appliances such as printers and copiers, industrial devices such as robots, medical devices such as radiation diagnosis devices, and transportation devices such as cars, ships, and airplanes. The in-device unit is, for example, an image capturing unit or a display unit in a camera, or a sheet conveyance unit or a fixing unit in an office appliance. Various devices can include at least one of an optical part such as a lens, a mirror, or a light source, an electronic part such as a memory, a sensor, or a display, and a mechanical part such as a drive source or a transmission mechanism in addition to a member including the product according to the present embodiment. Examples of the drive source include a motor, and examples of the transmission mechanism include a gear. For example, the product according to the present embodiment can be used as a part of the base of a fixing unit of a laser beam printer that is a kind of an office appliance. The laser beam printer can include optical parts such as a laser light source, a scanning lens, and a polygon mirror, electronic parts such as a processor and a memory, and mechanical parts such as a motor and a gear.

The present invention is not limited to the embodiments described above, and can be modified in many ways within the technical concept of the present invention. In addition, the effects described in the embodiment are merely enumeration of most preferable effects that can be obtained from the present invention, and the effects of the present invention are not limited to the effects described in the embodiments.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2020-209152, filed Dec. 17, 2020, which is hereby incorporated by reference herein in its entirety.

What is claimed is:

1. A method for manufacturing a product, the method comprising:

placing a processing target material on a die;

bringing a first punch into contact with the processing target material placed on the die; and bending the processing target material by pressing the processing target material by the first punch, wherein the processing target material has two first groove portions arranged at an interval in a first direction with reference to the processing target material and extending in the first direction, and a projection portion having a tapered shape, provided between the two first groove portions, and projecting with respect to bottom portions of the two first groove portions, wherein the projection portion has a pair of first inclined surfaces that are inclined such that the projection portion has a tapered shape whose distal end portion is narrower, and wherein an angle between the pair of first inclined surfaces is 80° to 90°, wherein the first punch has two pressing portions arranged at an interval in a second direction with reference to the first punch and extending in the second direction, and a recess portion having a bottom and being provided between the two pressing portions and recessed with respect to the two pressing portions, and wherein the bringing the first punch into contact with the processing target material placed on the die includes bringing the two pressing portions into contact with the two first groove portions and bringing the recess portion into contact with the projection portion.

2. The method according to claim 1, wherein, in the bending the processing target material by pressing the processing target material by the first punch, as the bending of the processing target material progresses, the first groove portions are deformed and retracted from the pressing portions, and the projection portion is deformed and flows toward the recess portion.

3. The method according to claim 1, wherein the recess portion has a pair of second inclined surfaces that are inclined such that the recess portion has a tapered shape whose bottom portion is narrower.

4. The method according to claim 3, wherein an angle between the pair of second inclined surfaces is 60° to 90°.

5. The method according to claim 1, wherein a width of the recess portion in the second direction is 0.9 times to 1.0 time of a width of the projection portion in the first direction.

6. The method according to claim 1, wherein a depth of each of the first groove portions is 0.3 times to 0.5 times of a thickness of the processing target material.

7. The method according to claim 1, the method further comprising forming the processing target material from a base material.

8. The method according to claim 7, wherein the forming the processing target material from the base material includes pressing a second punch against a first surface of the base material to form the two first groove portions and the projection portion on the first surface.

9. The method according to claim 7, wherein the forming the processing target material from the base material includes pressing a third punch against a second surface of the base material opposite to a first surface of the base material to form the projection portion on the first surface and pressing a fourth punch against the first surface to form the two first groove portions on the first surface.

10. The method according to claim 7, wherein the forming the processing target material from the base material includes pressing a fifth punch against a first surface of the base material to form a pair of second groove portions that extend in a direction intersecting with the first direction and are arranged at an interval in the first direction, and pressing a sixth punch against the first surface to form the two first groove portions.

11. The method according to claim 1, wherein the placing the processing target material on the die includes conveying the processing target material to the die by a conveyance apparatus.

12. The method according to claim 1, wherein the first punch is formed as a single body.

13. The method according to claim 1, wherein the first punch includes a plurality of blocks laminated in the second direction.

14. The method according to claim 1, wherein the projection portion is one of a plurality of projection portions.

15. The method according to claim 1, wherein the recess portion is one of a plurality of recess portions each having a bottom.

16. The method according to claim 15, wherein the projection portion is one of a plurality of projection portions, and wherein a number of the plurality of recess portions is larger than a number of the plurality of projection portions.

17. The method according to claim 1, wherein the processing target material has a third first groove portion different from the two first groove portions, and a second projection portion having a tapered shape and provided between the third first groove portion and one of the two first groove portions, wherein the first punch has a third pressing portion different from the two pressing portions and a second recess portion having a bottom and being provided between the third pressing portion and one of the two pressing portions, and wherein the bringing the first punch into contact with the processing target material placed on the die includes bringing the third pressing portion into contact with the third first groove portion and bringing the second recess portion into contact with the second projection portion.

18. A method for manufacturing a product, the method comprising:

placing a processing target material on a die;

bringing a first punch into contact with the processing target material placed on the die; and bending the processing target material by pressing the processing target material by the first punch, wherein the processing target material has two first groove portions arranged at an interval in a first direction with reference to the processing target material and extending in the first direction, and a projection portion having a tapered shape, provided between the two first groove portions, and projecting with respect to bottom portions of the two first groove portions, wherein the first punch has two pressing portions arranged at an interval in a second direction with reference to the first punch and extending in the second direction, and a recess portion provided between the two pressing portions and recessed with respect to the two pressing portions, wherein the recess portion has a pair of second inclined surfaces that are inclined such that the recess portion has a tapered shape whose bottom portion is narrower, and wherein an angle between the pair of second inclined surfaces is 60° to 90°, and wherein the bringing the first punch into contact with the processing target material placed on the die includes bringing the two pressing portions into contact with the two first groove portions and bringing the recess portion into contact with the projection portion.

19. The method according to claim 18, wherein the projection portion has a pair of first inclined surfaces that are inclined such that the projection portion has a tapered shape whose distal end portion is narrower.

20. The method according to claim 19, wherein an angle between the pair of first inclined surfaces is 80° to 90°.

* * * * *